US005815364A

United States Patent [19]

Hurley et al.

[11] Patent Number: 5,815,364

[45] Date of Patent: Sep. 29, 1998

[54] ULTRASONIC COIL CURRENT REGULATOR

[75] Inventors: Rick A. Hurley, Fletcher; Mark E. Innes, Asheville, both of N.C.

[73] Assignee: Eaton Corporation, Cleveland, Ohio

[21] Appl. No.: 781,480

[22] Filed: Oct. 18, 1991

[51] Int. Cl.[6] ..... H01H 47/02

[52] U.S. Cl. ..... 361/160; 361/154

[58] Field of Search ..... 361/153–155, 361/160

[56] References Cited

U.S. PATENT DOCUMENTS

| | | |
|---|---|---|
| 3,323,034 | 5/1967 | Dubin et al. . |
| 3,754,182 | 8/1973 | Morris et al. . |
| 3,925,709 | 12/1975 | Mitchell et al. . |
| 4,114,048 | 9/1978 | Hull et al. . |
| 4,131,935 | 12/1978 | Clement . |
| 4,166,205 | 8/1979 | Maier et al. . |
| 4,245,184 | 1/1981 | Billings et al. . |
| 4,251,743 | 2/1981 | Hareyama . |
| 4,316,136 | 2/1982 | Saxarra et al. . |
| 4,321,583 | 3/1982 | Baron et al. . |
| 4,331,997 | 5/1982 | Engel et al. . |
| 4,366,469 | 12/1982 | Michaels et al. . |
| 4,384,321 | 5/1983 | Rippel . |
| 4,399,416 | 8/1983 | Gillespie . |
| 4,467,260 | 8/1984 | Mallick, Jr. et al. . |
| 4,471,418 | 9/1984 | Tuma . |
| 4,503,408 | 3/1985 | Mrenna et al. . |
| 4,511,945 | 4/1985 | Nielsen ..... 361/154 |
| 4,550,360 | 10/1985 | Dougherty . |
| 4,554,501 | 11/1985 | Baker . |
| 4,556,838 | 12/1985 | Brasseur . |
| 4,618,848 | 10/1986 | Parfitt . |
| 4,626,831 | 12/1986 | Engel . |
| 4,644,566 | 2/1987 | Vercellotti et al. . |
| 4,677,366 | 6/1987 | Wilkinson et al. . |
| 4,683,415 | 7/1987 | Zimmerman . |
| 4,698,740 | 10/1987 | Rodgers et al. . |
| 4,712,169 | 12/1987 | Albach . |
| 4,731,722 | 3/1988 | Conroy . |
| 4,746,899 | 5/1988 | Swanson et al. . |
| 4,812,736 | 3/1989 | Albach et al. . |
| 4,831,378 | 5/1989 | Baars et al. . |
| 4,851,843 | 7/1989 | Neal . |
| 4,864,213 | 9/1989 | Kido . |
| 4,870,418 | 9/1989 | Kal et al. . |
| 4,876,502 | 10/1989 | Verbanets et al. . |
| 4,893,102 | 1/1990 | Bauer . |
| 4,910,631 | 3/1990 | Murphy . |
| 4,940,929 | 7/1990 | Williams . |
| 4,940,981 | 7/1990 | Naylor et al. . |
| 4,942,509 | 7/1990 | Shires et al. . |
| 4,964,029 | 10/1990 | Severinsky et al. . |
| 5,003,454 | 3/1991 | Bruning . |
| 5,006,975 | 4/1991 | Neufeld . |

FOREIGN PATENT DOCUMENTS

| | | |
|---|---|---|
| 2155266 | 9/1985 | United Kingdom . |
| WO 87/01765 | 3/1987 | WIPO . |

OTHER PUBLICATIONS

Manzoul, M.A. "Interrupt–Driven Microprocessor–Based Overcurrent Relay", IEEE, 0278–0046/91/0200–0008, vol. 38, No. 1, Feb. 1991, pp. 8–9.

(List continued on next page.)

*Primary Examiner*—Fritz Fleming
*Attorney, Agent, or Firm*—Martin J. Moran

[57] ABSTRACT

A control circuit for electrical contactors, starters and the like which include one or more pairs of separable main contacts is controlled by an electromagnet assembly. In order to reduce, if not eliminate, audible noise generated by the electromagnet assembly, the electrical current to the electromagnetic assembly is regulated to minimize the rate of change of magnetic flux therethrough to thereby reduce, if not eliminate, audible noise. By regulating the electrical current to the electromagnet assembly, the power consumption of the electromagnet assembly is reduced which, in turn, reduces undesirable heating of a solenoid coil within the electromagnet assembly.

14 Claims, 21 Drawing Sheets

OTHER PUBLICATIONS

Mendis, S.R., Biship, M.T., Gonzalez, D.A. "Rule–Based Coordination Program Evaluates Distribution Transformer Overcurrent Protection Alternatives", IEEE, 0895–0156/91/0400–0031, Apr. 1991, pp. 31–36.

Noujaim, S.E. "Monolihic Sensor Interfaces With On–Board Digital Signal Processing", pp. 652–657, no date provided by applicants.

Vaglica, J.J., Gilmour, P.S. "How To Select A Microcontroller", IEEE, IEEE Spectrum, 0018–9235/90/1100–00106, Nov. 1990, pp. 106–109.

Clarcia, S., Brown, G "Using The Motorola MC68HC11", Circuit Cellar Ink. Dec. 90/Jan. 91, pp. 36–48.

Westinghouse Electric Corp., Distribution & Control Business Unit, "IQ Data", Descriptive Bulletin 8171, Mar. 1990, pp. 1,2.

FIG. 4
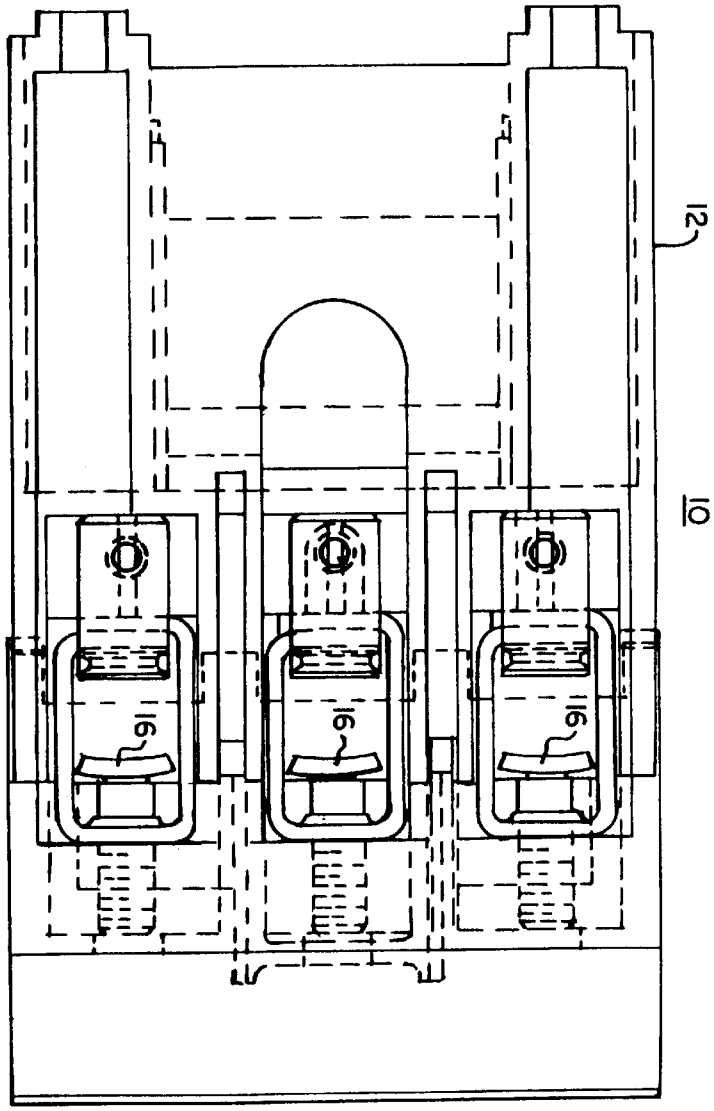
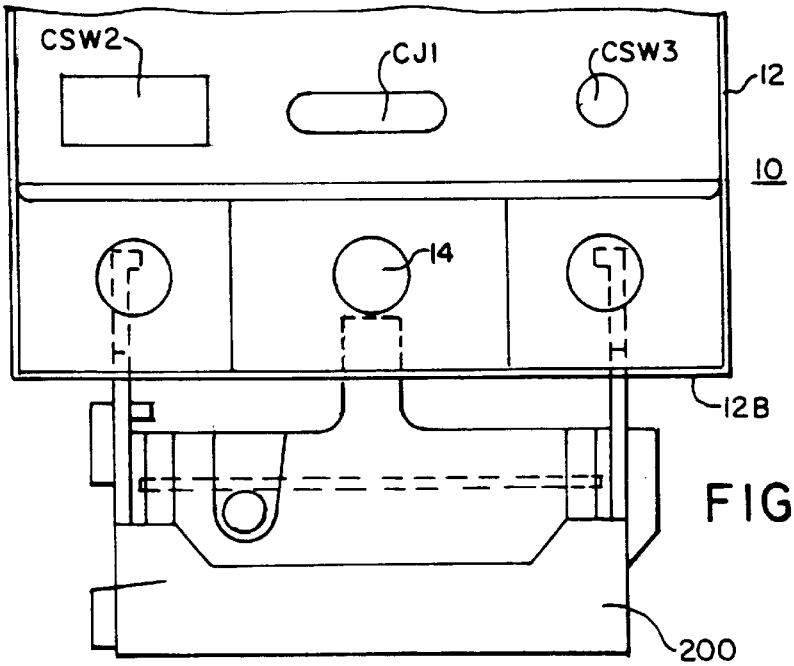
FIG. 5

VREG
(202A)
24V
V
(203A)
24V
+MVU
(204A)
24V
t
I
II
III
IV
ON
OFF
ON
SWITCH VSSW
DIODE MCR7
CONDUCTING
NON-CONDUCTING
NON-CONDUCTING

ULTRASONIC COIL CURRENT REGULATOR

CROSS REFERENCE TO RELATED APPLICATIONS

This application is related to patent application Ser. No. 08/073,636, filed on Jun. 8, 1993, now U.S. Pat. No. 5,325,315 issued on Jun. 28, 1994, which is a continuation of patent application Ser. No. 07/636,000, filed on Dec. 28, 1990, entitled, A PROCESS FOR AUTOCALIBRATION OF A MICROPROCESSOR BASED OVERCURRENT DEVICE AND APPARATUS, by Joseph C. Engel, Gary F. Saletta, Marlan L. Winter and Edward C. Prather, Westinghouse Case No. WE-56,158.

This patent application generally relates to electrical contactors and starters. U.S. Pat. No. 5,168,418 filed on Apr. 19, 1991, issued on Dec. 1, 1992 entitled, DOUBLE DC COIL TIMING CIRCUIT, by Rick Hurley and Mark Innes also relates to electrical contactors.

BACKGROUND OF THE INVENTION

1. Field of the Invention

The present invention relates to electrical contactors, electrical starters, motor controllers and like devices which include an electromagnetic assembly and one or more poles for connecting a source of electrical power to an electrical load, such as an electrical motor and more particularly to a control circuit for controlling the electrical current applied to a coil in the electromagnetic assembly which automatically compensates for magnetic coupling from the main poles while eliminating audible noise and providing a relatively higher hold in force than known devices.

2. Description of the Prior Art

Various electrical devices are known in the art for controlling electrical equipment, such as motors and the like. These devices include starters, combination starters, contactors, motor controllers and the like for controlling both single phase and multiple phase electrical equipment in reversing as well as non-reversing applications. Such devices include one or more pairs of separable main contacts disposed between such electrical equipment and a source of electrical power. In such devices, the separable main contacts are mechanically interlocked with an armature that is controlled by an electromagnetic assembly. In known devices, one or more biasing springs, are generally used to maintain the separable main contacts in a normally open position. In order to close the separable main contacts, sufficient force must be generated by the electromagnetic assembly in order to overcome the compression force of the biasing springs. Moreover, once the separable main contacts are closed, it is necessary to provide sufficient electrical power to the electromagnet assembly to overcome the compression force of the biasing springs when the separable main contacts are to remain in such a closed position.

In known electromagnetic contactors, such as the electromagnetic contactor disclosed in U.S. Pat. No. 4,893,102, assigned to the same assignee as the assignee of the present invention, the electrical voltage and electrical current to the coil in the electromagnet assembly are controlled to overcome the compression force of the biasing springs both during a closing operation of the separable main contacts as well as to maintain the separable main contacts in a closed position. More specifically, FIG. 6 of the aforementioned U.S. patent illustrates the electrical voltage and electrical current profiles utilized in order to close the separable main contacts as well as maintain the separable main contacts in a closed position. As described in detail in the aforementioned U.S. patent, the electrical voltage and current profiles are determined as a function of the force required to overcome the compression force of the biasing springs during the various stages of a closing stroke. As illustrated in FIG. 6 of the aforementioned U.S. patent, a full wave rectified but unfiltered source of alternating current (AC) voltage is applied to the coil. The electrical current applied to the coil is controlled such that the electrical power developed by the electromagnet assembly in the various stages of the closing stroke is controlled to overcome the compression force of the biasing springs. Thus, as shown in FIG. 6 of the aforementioned patent, an electrical current profile consisting of a plurality of electrical current pulses is applied to the coil in the electromagnet assembly. The amplitudes of the peaks of the pulses of the electrical current profile are controlled during each stage of the closing stroke in order to provide a force, greater than the compression force of the biasing springs. More specifically, the amplitudes of the electrical current pulses are controlled by controlling the phase angle of the electrical current applied to the coil in the electromagnet by way of a triac and microprocessor as described in detail in the aforementioned U.S. patent. As shown in FIG. 6 of the aforementioned patent, an electrical current pulse is applied to the coil once each half cycle during the closing stroke and indefinitely thereafter for as long as the separable main contacts are to remain closed in order to overcome the compression force of the biasing springs during such a condition.

There are several problems associated with the control system described in detail in the aforementioned U.S. patent. First, the relatively slow update rate of the electrical current pulses applied to the coil in the electromagnet assembly can result in audible noise of the electromagnet assembly. More specifically, as previously mentioned, the current pulses are updated every half cycle. Consequently, such a pulse rate can cause a relatively high rate of change of magnetic flux within the coil which results in audible noise. Second, such a relatively slow update rate could result in the main contacts opening as a result of magnetic coupling from the poles. More specifically, when the electrical contactor is in a closed position the electrical current flowing through the poles generates a magnetic field. Due to the proximity of the poles to the electromagnet assembly, the magnetic field generated in the poles is coupled to the coil in the electromagnetic assembly by transformer action. Since the force required to open the contacts is determined by the lowest decay point of the electrical current in the coil between updates and since the updates are so far apart, the compression force of the biasing springs between updates could cause the contacts to open as a result of relatively large amounts of magnetic coupling from the poles between updates. Another problem with the control circuit described in the aforementioned patent is that because of the relatively low update rate, a relatively large amount of electrical power must be supplied to the coil in order to maintain the contacts in a closed position. This power causes coil heating, which is undesirable.

SUMMARY OF THE INVENTION

It is an object of the present invention to solve the problems associated with the prior art.

It is another object of the present invention to provide a control circuit for electrical contactors and the like for providing a regulated electrical current to the coil such that no audible noise is emitted from the electromagnet assembly.

It is another object of the present invention to provide a control circuit for electrical contactors and the like which compensates for magnetic coupling from the main poles.

It is another object of the present invention to reduce coil heating in the electromagnet assembly.

It is yet another object of the present invention to provide a control circuit which prevents the separable main contacts for opening as a result of magnetic coupling from the main poles.

Briefly, the present invention relates to a control circuit for electrical contactors, starters and the like which include one or more pairs of separable main contacts controlled by an electromagnet assembly. In order to reduce, if not eliminate, audible noise generated by the electromagnet assembly, the electrical current to the electromagnetic assembly is regulated to minimize the rate of change of magnetic flux therethrough to thereby reduce, if not eliminate, audible noise. The circuitry is also adapted to compensate for alternating current (AC) magnetic coupling from the main poles in order to provide a relatively larger hold in force when the contacts are to remain in a closed position. By regulating the electrical current to the electromagnet assembly, the power consumption of the electromagnet assembly is reduced which, in turn, reduces undesirable heating of a solenoid coil within the electromagnet assembly. The control circuit includes plurality power switches adapted to be serially coupled to the solenoid coil within the electromagnet assembly. The power switches are under the control of a drive circuit, a trigger circuit and a timing circuit. The drive circuit in cooperation with the timing circuit allows the electrical current flowing through the solenoid coil to rise to a predetermined level. After the electrical current reaches the predetermined level, the trigger circuit triggers the timing circuit in order to disable the drive circuit for a predetermined time period to allow electrical current through the solenoid coil to decay. After the time period has timed out, the timing circuit enables the drive circuit to allow the electrical current through the solenoid coil to build up to the predetermined level. Once the electrical current in the coil reaches a predetermined level, the cycle is repeated.

BRIEF DESCRIPTION OF THE DRAWINGS

For a better understanding of the invention, reference is made to the preferred embodiment thereof, shown in the accompanying drawings in which:

FIG. 4 shows a top view of the apparatus of FIG. 1;

FIG. 5 shows a partially broken away front elevation of the apparatus of FIG. 1, with the communications module in an alternative arrangement on the bottom of the assembly;

DETAILED DESCRIPTION

Figure 8:
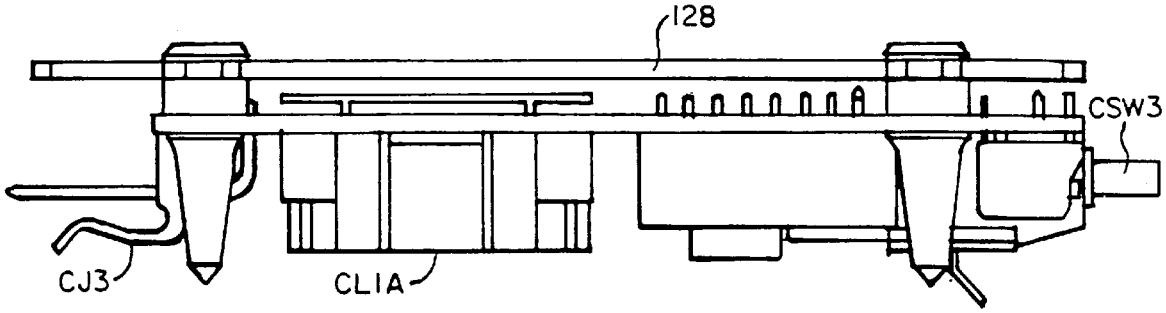
FIG. 8 shows a side view of the circuit board assembly of FIGS. 6 and 7.
Figure 9:
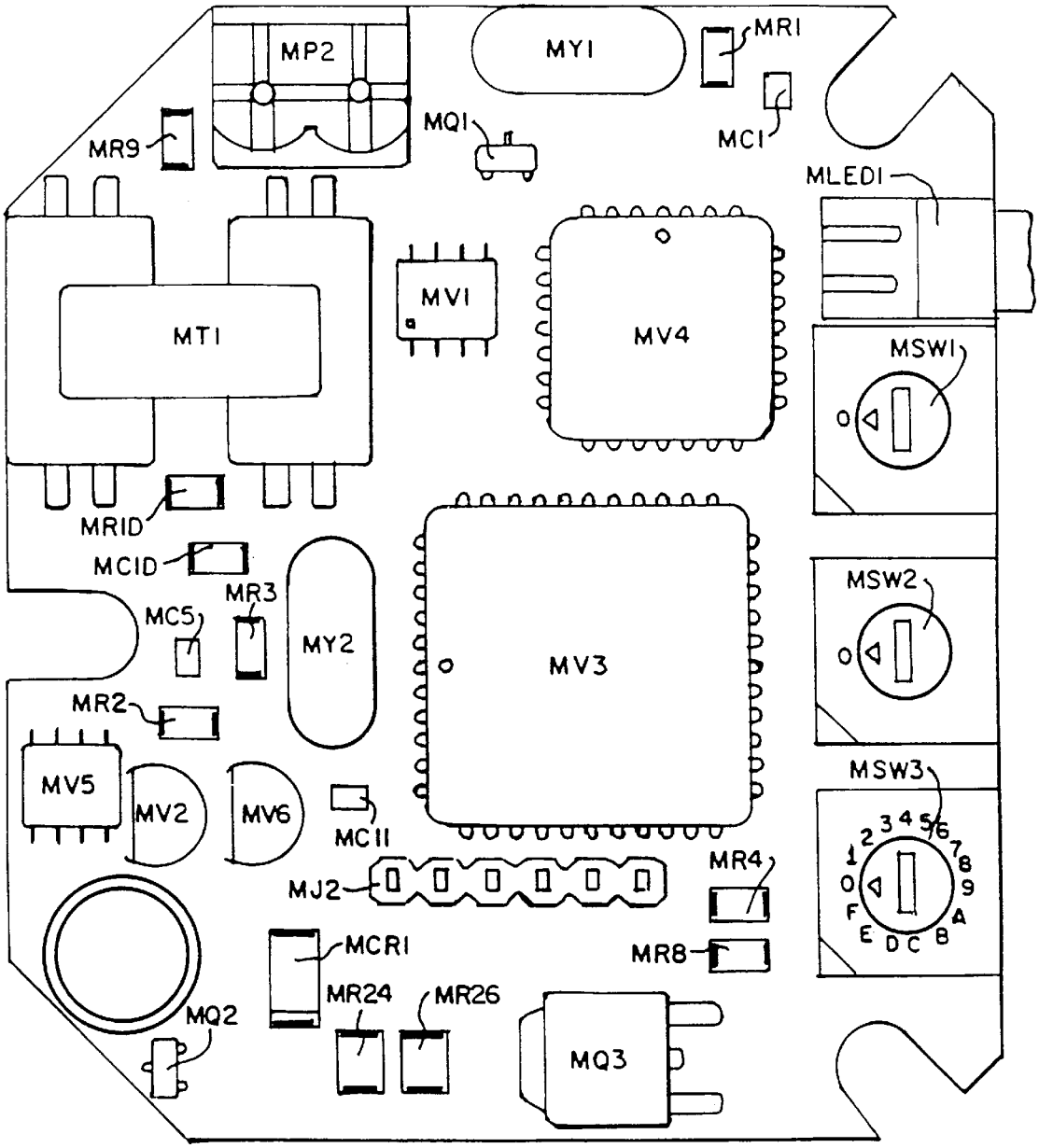
FIG. 9 shows a layout view of the circuit board of the communication module in FIGS. 1 and 5.

Referring now to the drawings and FIGS. 1–5, in particular, an electromagnetic contactor or motor controller 10 is depicted. The contactor or motor controller may be of the type depicted in U.S. Pat. No. 4,893,102 issued Jan. 9, 1990, to J. A. Bauer, and entitled: ELECTROMAGNETIC CONTACTOR WITH ENERGY BALANCED CLOSING SYSTEM. U.S. Pat. No. 4,893,102 is incorporated by reference herein. It should be understood with respect to the embodiments incorporated by reference from U.S. Pat. No. 4,893,102 that the physical arrangement of the control circuit board as shown best in FIGS. 8, 9 and 10 thereof may be different than the circuit board arrangements depicted herein. Although the description of the operation of the contactor or motor control system is extensively explained in U.S. Pat. No. 4,893,102, it will be briefly outlined herein in a less detailed form. Contactor 10 is a type of device that acts in the presence of a predetermined value of an input electrical variable such as line or phase current to perform a function such as closing contacts to start a motor or stop a motor.

Figure 2:
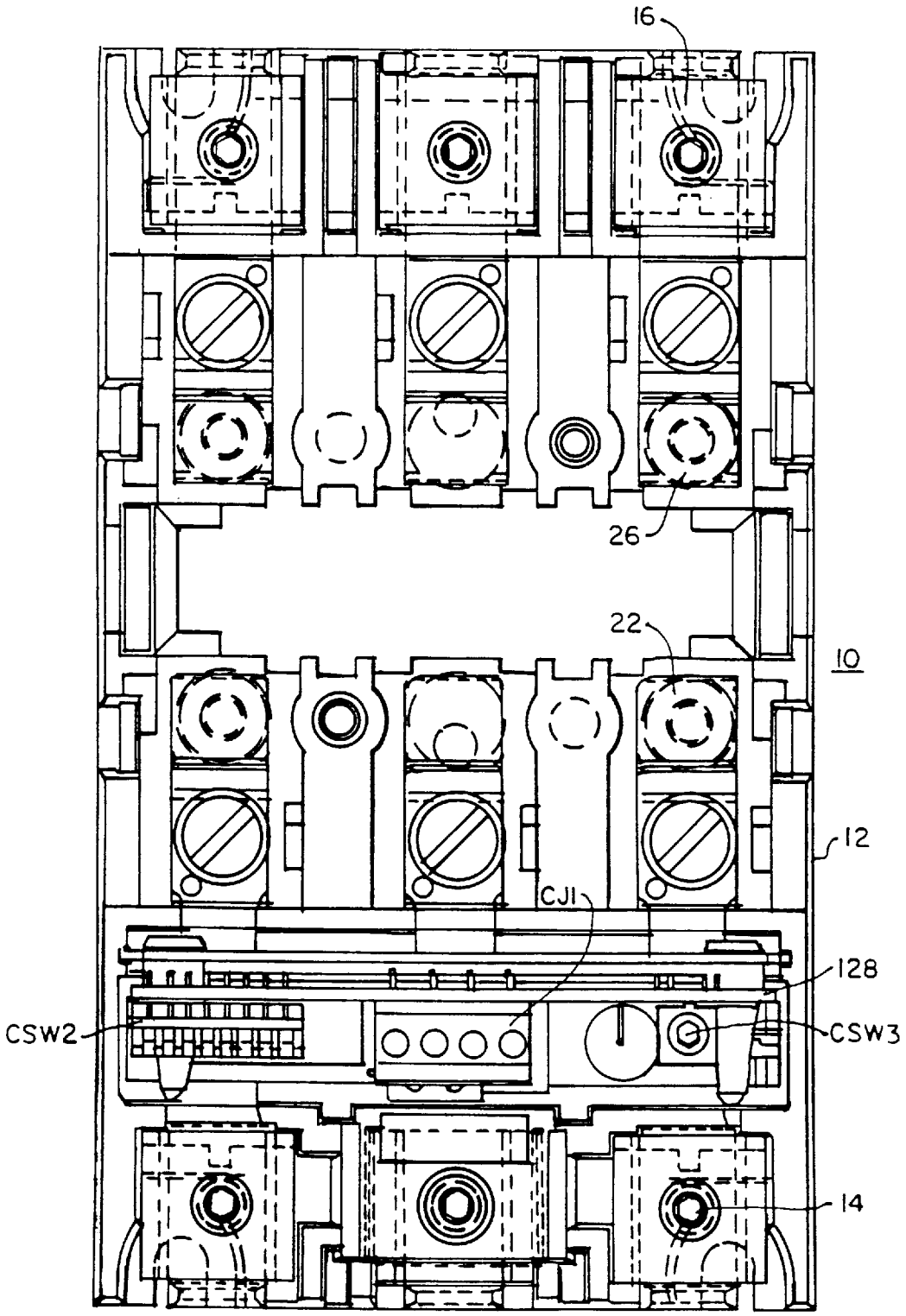
FIG. 2 shows a front elevation in the same orientation as FIG. 1 of the motor control apparatus or contactor with arc box, magnetic subassembly, and crossbar subassembly omitted.
Figure 3:
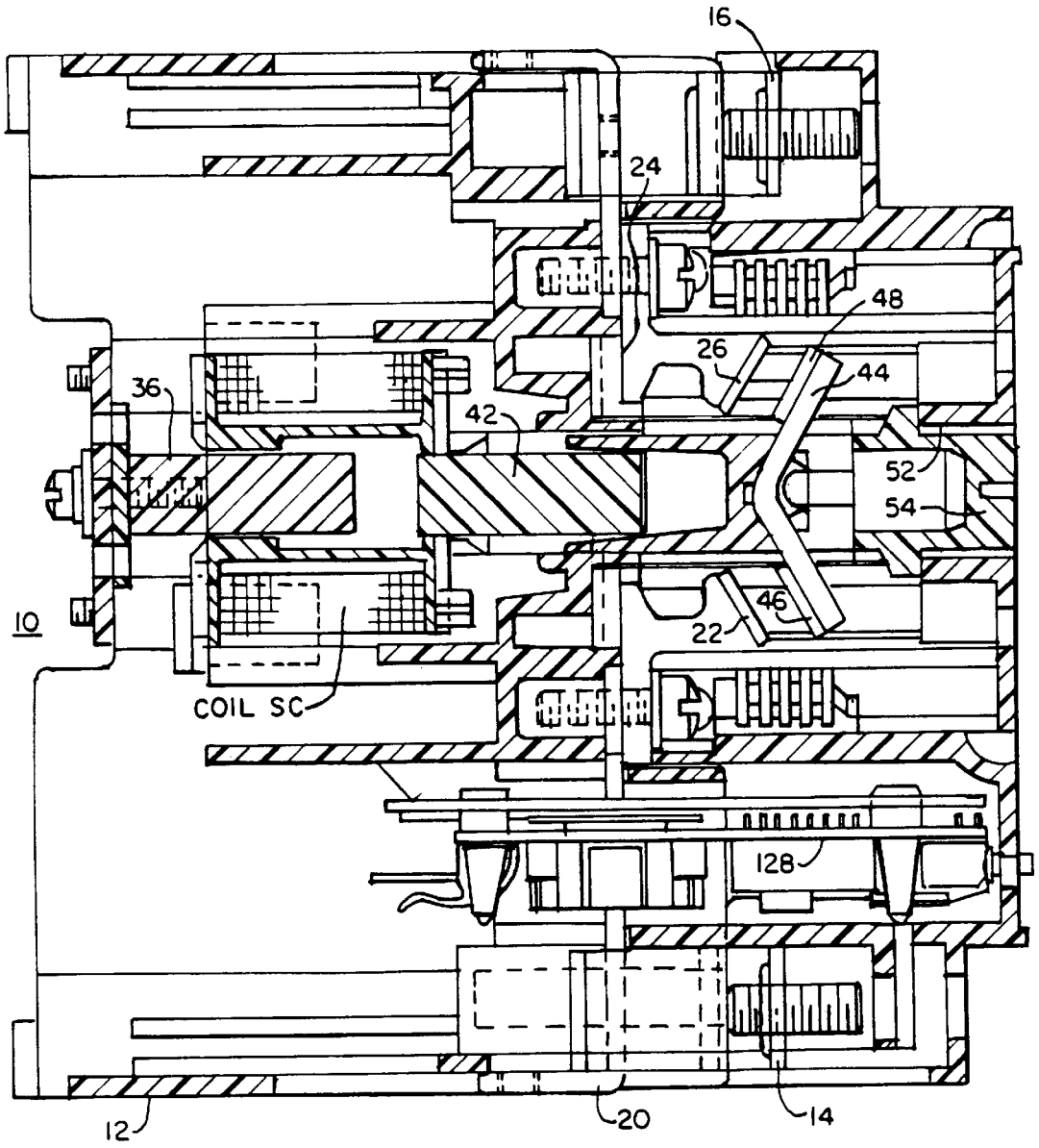
FIG. 3 shows a side elevation cut away along plane III—III of FIG. 1, of the microprocessor controlled circuit board assembly.
Figure 7:
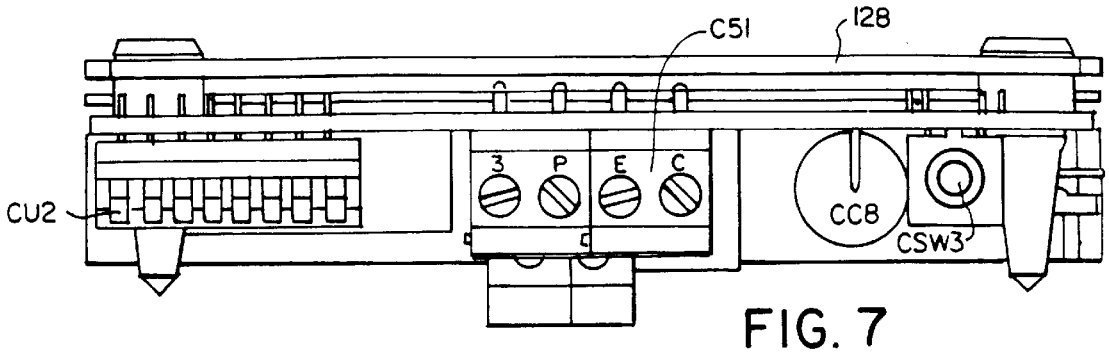
FIG. 7 shows a front view of the circuit board assembly of FIG. 6.

Referring specifically to FIG. 3, the contactor arrangement of the present invention is depicted with reference symbols referring to like or similar elements in the contactor of FIG. 2 of the incorporated-by-reference U.S. Pat. No. 4,893,102. In particular, there is provided a contactor or motor control apparatus 10 having an insulating housing 12. There are a pair of spaced-apart load terminals 14, 16 suitable for interconnection with an electrical load such as a motor winding which is to be controlled by the contactor or motor control device 10. Load terminal 14 is interconnected with internal conductor 20 and load terminal 16 is interconnected with internal conductor 24. Internal conductor 20 is interconnected with a fixed contact 22 and internal conductor 24 is interconnected with a fixed contact 26. There is provided a contact carrier 42 upon which is disposed an electrically conducting contact bridge 44 having movable contacts 48, 46 at either end thereof which are complementary with fixed contacts 26, 22, respectively. The contact carrier 42 is movable in controlled relationship such that the contact bridge 44 which is affixed thereto and movable therewith causes the contacts 48, 46 to abut against contacts 26, 22, respectively, when there is a need or desire to close the circuit between terminals 14, 16. In a like manner, internal operations of the contactor or motor controller 10 is such that the contacts 48, 46 may separate from contacts 26, 22, respectively, and remain in a disposition of separation as a function of carrier 42 moving in a different direction and causing the rigidly affixed bridge member 44 to move correspondingly. Generally, as is described in incorporated-by-reference U.S. Pat. No. 4,893,102, the movement of carrier 42 and concurrent movement of the bridging member 44 is controlled by a control card or control board 128 which may include a microprocessor as a control element. Generally, when the magnitude of electrical current flowing between terminals 14, 16, when the contactor 10 is in a closed disposition, is appropriate, the control board 128, upon sensing that current will cause appropriate action to take place with regard to component magnetic structures, electromagnetic solenoid structures (such as COIL SC), and various aligned springs, to cause the contacts 48, 46 to separate from contacts 26, 22, respectively. Furthermore, the contacts may be opened or closed manually or they may be closed in response to electromagnetic interaction in a manner described, for example, in the incorporated-by-reference U.S. Pat. No. 4,893,102. The general operation of the circuit board 128 of the present invention is such that it may operate similarly to the circuit board arrangement 128 shown and described in the incorporated-by-reference U.S. Pat. No. 4,893,102. In the present invention, apparatus and process for calibrating the circuit board 128 is described hereinafter.

Figure 1:
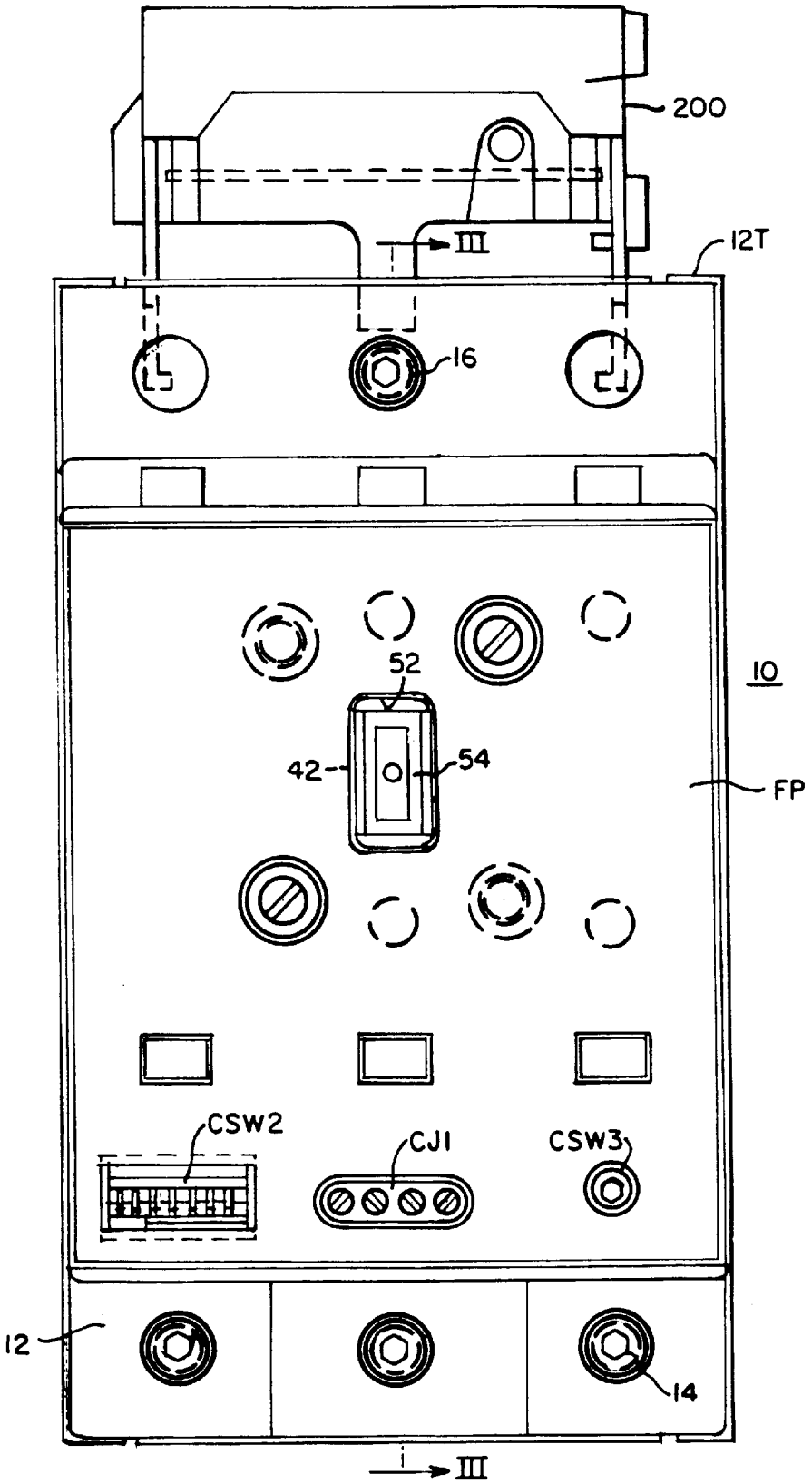
FIG. 1 shows a front elevation of an electromagnetic contactor or motor control apparatus with a communications module affixed to the top thereof.

Referring specifically to FIG. 1, the front elevation of the apparatus shown in section and described previously with respect to FIG. 3, is depicted. In particular, there is provided an opening or orifice 52 in which a guiding or bridging member 54 is affixed in order to longitudinally and radially align the movable carrier 42. The front panel FP of the contactor 10 contains three orifices or openings through which important construction features portions or parts of the circuit board arrangement 128 are accessible. These portions or parts are a switch CSW2, connector CJ1, and switch CSW3. The construction, operation and function, of the accessible elements will be described hereinafter. At the top portion 12T of the contactor 10 is disposed in detachably attached a communication module 200, the construction, operation and purpose of which will be described hereinafter.

Referring now to FIG. 2, the contactor arrangement shown in FIG. 1 is depicted in similar orientation except that the front panel FP, including that which is called the "arc box", as well as the magnetic subassembly and the crossbar assembly have been omitted or removed. In particular, the arrangement of the circuit control card 128 within the contactor internal portion is once again depicted. The arrangement of elements CSW2, CJ1 and CSW3 is clearly shown.

Referring to FIG. 4, a top view of the contactor 10 is shown. In particular, the arrangement of the three-phase load terminals 16 is clearly set forth.

In FIG. 5 another embodiment of the invention is shown in which the communication module 200 is detachably attached to the contactor 10 at the bottom 12B thereof.

CONSTRUCTION FEATURES OF THE CONTROL CIRCUIT BOARD 128

Referring now to FIGS. 6–8 and 10A–10C, the construction features of the control board 128 are described. As shown best in FIG. 10A, there is provided an input connector CJ1 having terminals 1, 2, 3, 4. Terminal 4 is connected to system common or ground (hereinafter "ground"). One side each of resistive elements CR28, CR29, CR34, CR35 are also connected to ground. Terminal 4 is designated "C". Terminal 1 is connected to one side of a resistive element CR1 to one side each of resistive elements CR28, CR34 and to an output designated "3". Terminal 2 is connected to one side of a resistive element CR2, to a terminal "P", and to one side each of resistive elements CR29, CR35. Terminal 3 is connected to one side of a resistive element CR3, to a terminal "E" and to one side of a varistor element CMV1. Terminal "E" may have impressed thereupon a control voltage to ground. In one embodiment of the invention that value may be 120V AC. The other side of resistive element CR1 is connected to one side of capacitive element CC1, and to terminal CP2 and terminal PC1 of an integrated circuit chip CU1. The construction and operation of chip CU1 will be described hereinafter. The other side of resistive element CR2 is connected to one side of a capacitive element CC2 and to terminal CP1 and terminal PC0 of chip CU1. The other side of resistive element CR3 is connected to one side of a capacitive element CC3 and to terminal CPO of chip CU1. The other side of the varistor CMV1 and capacitive elements CC1, CC2, CC3 are connected to ground. The three-phase sensors designated CL1A, CL1B and CL1C are connected at one side each thereof to ground and to one side each of resistive elements CR6, CR5 and CR4, respectively. The other side of resistive elements CR4, CR5, CR6 are connected to input terminals MUX2, MUX1, MUX0 respectively of chip CU1. The latter inputs are designated "PHASE3", "PHASE 2" and "PHASE 1", respectively. The foregoing represents the current sensing arrangement for the system.

Figure 10A:
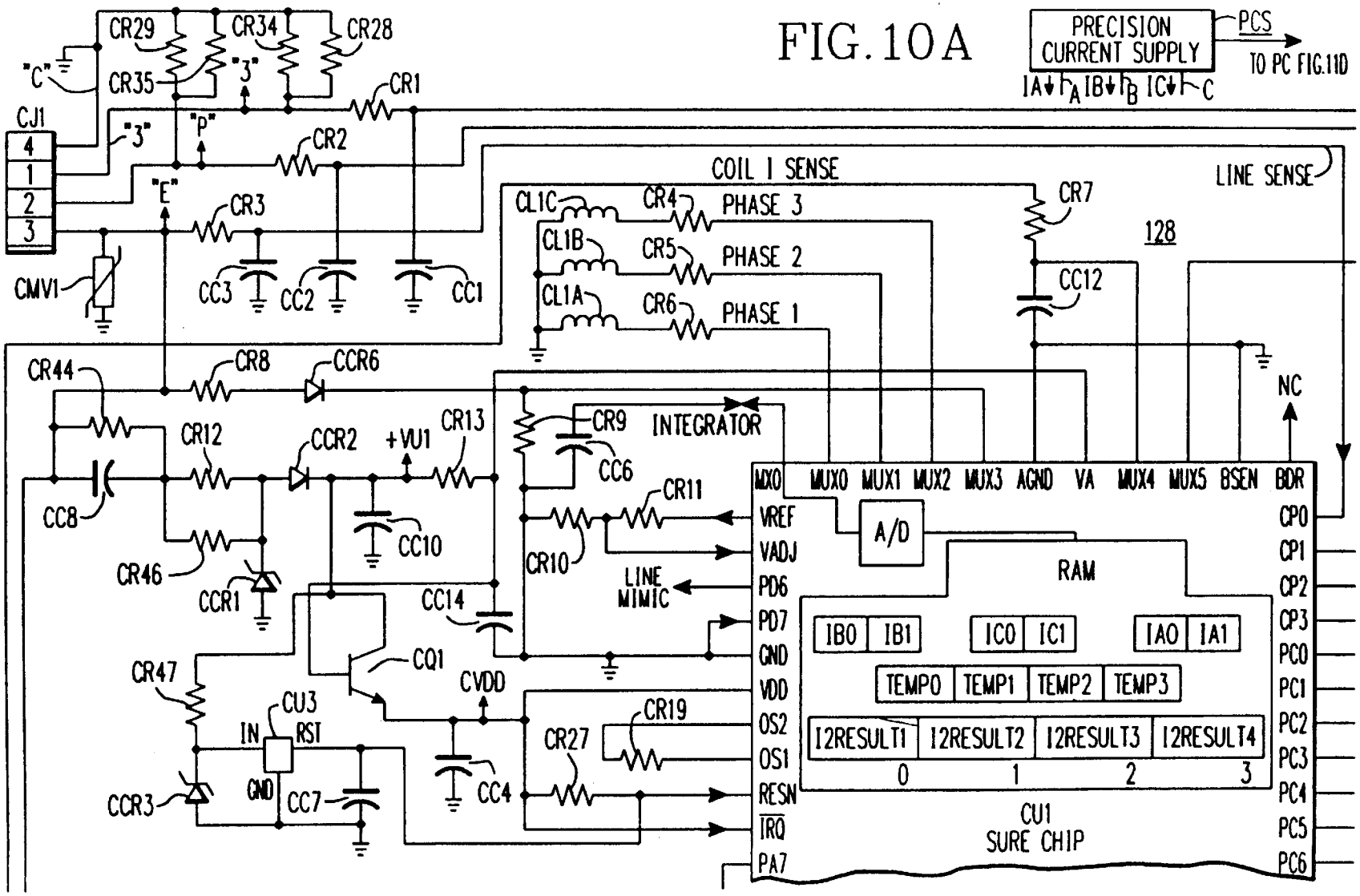
FIGS. 10A–10C show a circuit schematic diagram of the circuit board assembly shown in FIGS. 3, 6, 7 and 8.
Figure 10B:
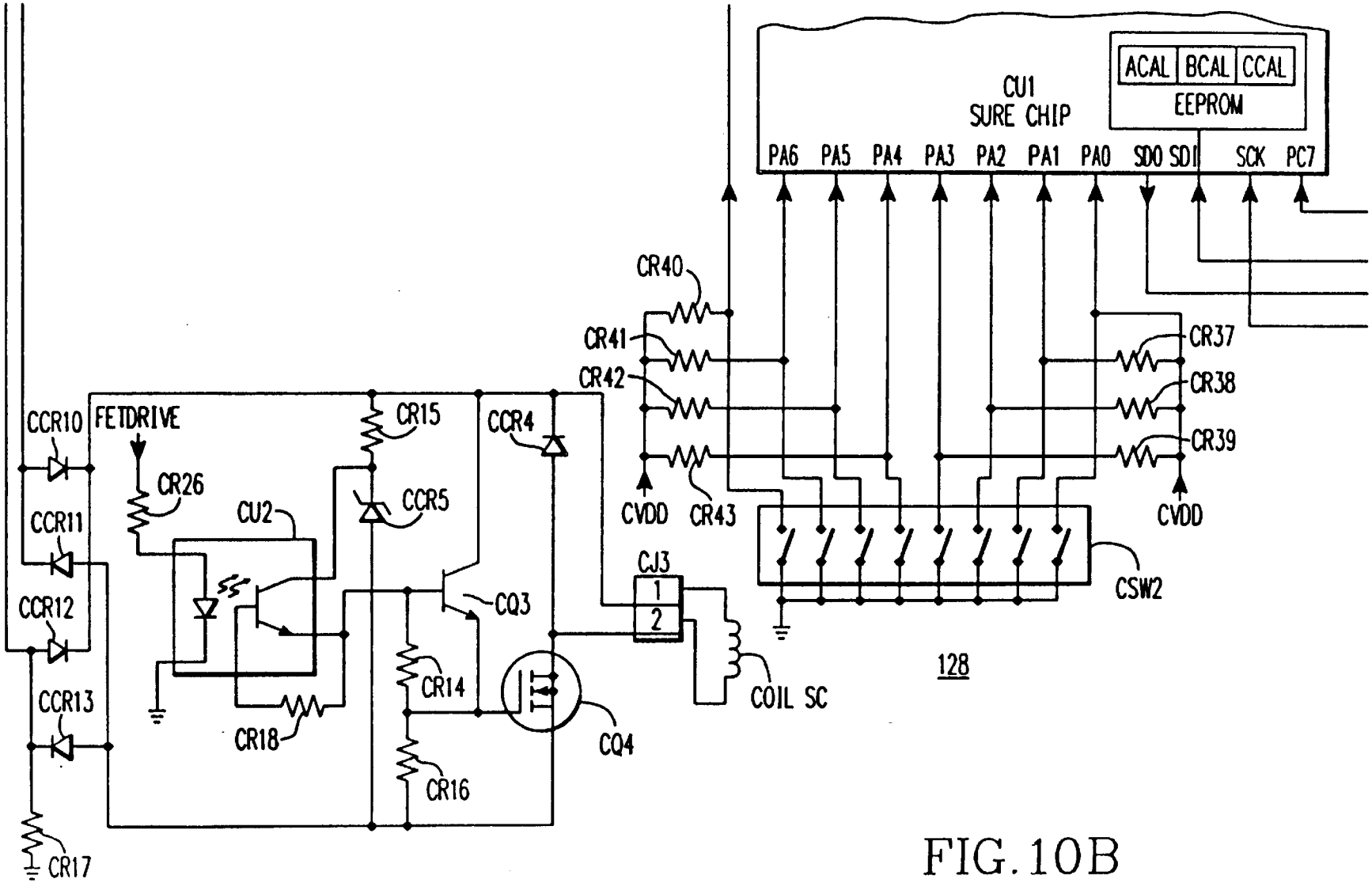
Figure 10C:
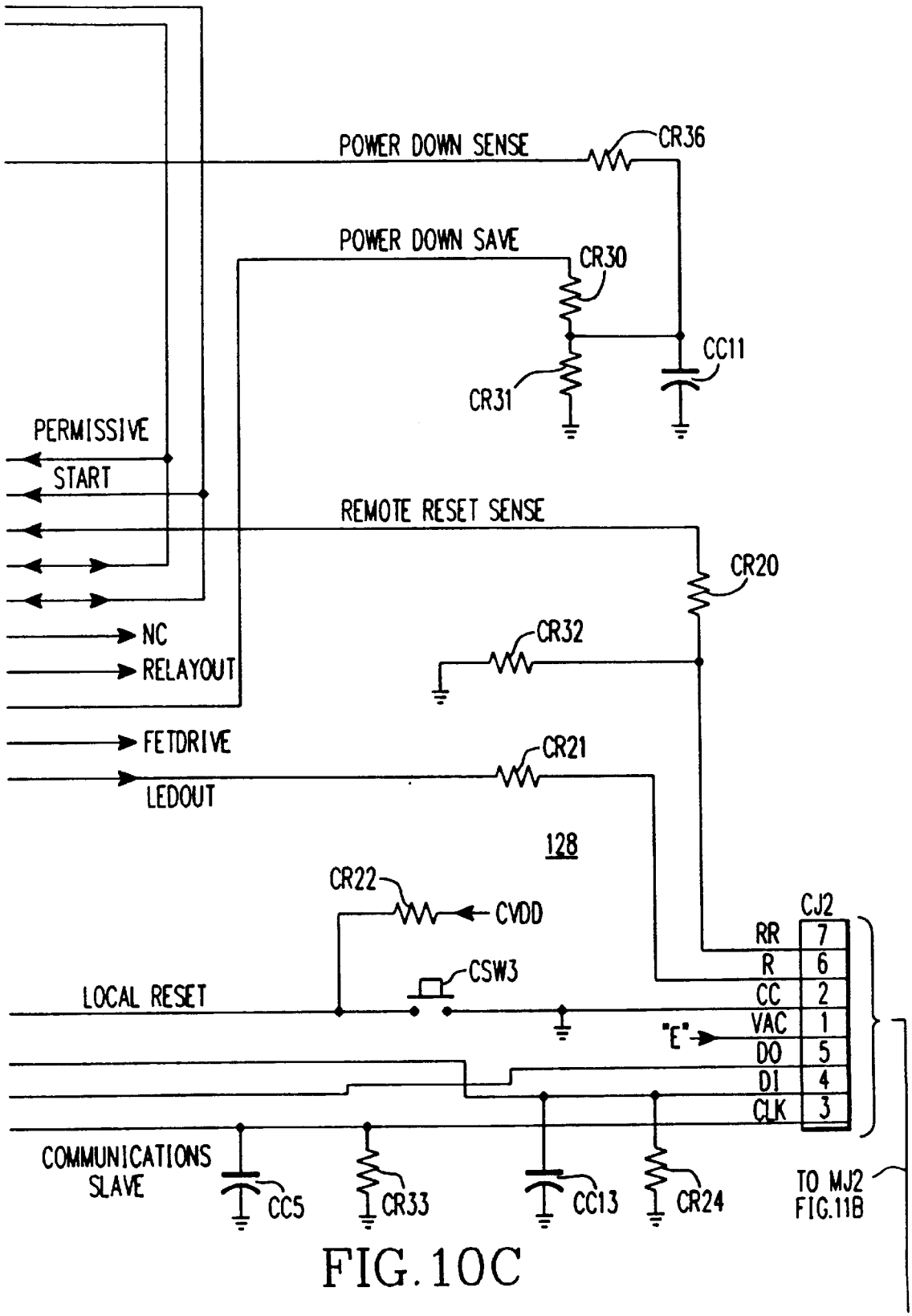

Referring now to FIGS. 10B and 10C, there is shown an input connector CJ2 which is externally interconnectable with the communication module 200, in a manner to be described hereinafter. Terminal 7 of connector CJ2, designated "RR", is connected to one side of a resistive element CR20 and one side of a resistive element CR32. The other side of resistive element CR32 is connected to ground. The other side of resistive element CR20 is designated "REMOTE RESET SENSE" and is connected to the CP3 terminal of the chip CU1. Terminal 6 of connector CJ2 is designated "R" and is connected to one side of a resistive CR21, the other side of which is connected to terminal PC6 of chip CU1. This is designated the "LEDOUT" terminal. Chip CU1 may be of the type known as a SURECHIP which is a proprietary device of the Westinghouse Electric Corporation. The SURECHIP will be described in detail hereinafter. Terminal 2 of connector CJ2 is designated "CC" and is connected to ground. Terminal 1 of connector CJ2 is designated "VAC" and is connected to the "E" control voltage as described previously. Terminal 5 of connector CJ2 is designated "DO" for data out and is connected to the output terminal SDO of the chip CU1. Terminal 4 of connector CJ2 is designated "DI" for data in and is connected to one side of a resistive element CR24, one side of capacitive elements CC13, and to the input terminal SD1 of the chip CU1. The other side of resistive element CR24 and the other side of capacitive element CC13 are connected to ground. Terminal 3 of the connector CJ2 is designated "CLK" for clock is connected to one side of resistive element CR33, one side of a capacitive element CC5, and to the SCK terminal of the chip CU1. This terminal is designated "COMMUNICATIONS SLAVE". The other side of resistive element CR33 and the other side of capacitor element CC5 are connected to ground.

The terminal PC7 of the chip CU1 is connected to one side of a resistive element CR22 and one side of the switch CSW3. The other side of the switch CSW3 is connected to ground. The other side of resistive element CR22 is interconnected to have impressed thereupon voltage CVDD, the supply of which will be described hereinafter. Switch CSW3 is a normally open push-button switch. Terminals PA0 through PA7 of chip CU1 are connected to separate terminals of the programming switch CSW2. Each of the terminals PA1 through PA7 is connected to one side of an appropriate resistive elements CR37 through CR43. The other side of resistive elements CR37 through CR43, respectively, is connected to voltage source CVDD. Terminal AGND and terminal BSEN of chip CU1 is connected to ground.

Capacitive element CC12 is connected at one side thereof to ground. The other side capacitive element CC12 is connected to terminal MUX4 of the chip CU1, and to one side of a resistive element CR7. The other side of resistive element CR7 is connected to the anode of a diode CCR12 and the cathode of a diode CCR13, as well as one side of a resistive element CR17, the other side of which is connected to ground. The anode of diode CCR13 is connected to the anode of a diode CCR11, to the anode of a zener diode CCR5, to one side of a resistive element CR16, and to the drain terminal of a field effects transistor CQ4. The cathode of the diode CCR12 is connected to the cathode of a diode CCR10, to one side of a resistive element CR15, to the cathode of a diode CCR4 to the collector of a transistor CQ3, and to terminal 1 of a connector CJ3. Connector J3 is interconnected to one side of a solenoid coil COIL SC in the contactor 10 for control of the armature member or carrier 42 in a manner described previously with respect to the incorporated-by-reference U.S. Pat. No. 4,893,102. The other side of the coil COIL SC is connected to terminal 2 of the connector CJ3. Terminal 7 of connector CJ3 is connected to the source terminal of the field effects transistor CQ4, and to the anode of diode CCR4. The other side of the resistive element CR15 is connected to the anode of zener diode element CCR5. The junction point between the resistive element CR15 and the anode of zener diode CCR5 is connected to the collector terminal of an output transistor of a chip CU2. The emitter terminal of the transistor of chip CU2 is connected to one side of a resistive element CR18, one side of a resistive element CR14, the base of transistor CQ3. The emitter of transistor CQ3 is connected to the gate terminal of the field effect transistor CQ4, to the other side of the resistive element CR14, and to the other side of the resistive element CR16. The other side of resistive element CR18 is connected to the base of the transistor element of the chip CU2. The input circuit for the chip CU2 comprises a light-emitting diode, the anode of which is connected to one side of a resistive element CR26 and the cathode of which is connected to the system common or ground. The other side of the resistive element CR26 is connected to receive the signal "FET DRIVE" from the chip CU1. The chip CU2 represents a diode-driven transistor output isolating device comprising a light-emitting diode as the input and a light-receptive transistor as the output. It essentially acts as an isolation device.

The anode of the diode CCR10 and the cathode of the diode CCR11 are connected together and to one side of a resistive element CR44, one side of a capacitive element CC8, one side of a resistive element CR8, and to the control voltage "E". The other side of the resistive element CR44 and the other side of the capacitive element CC8 are connected to one side of a resistive element CR12 and one side of a resistive element CR46. The other side of resistive element CR12 and the other side of resistive element CR46 are interconnected together, and the anode of a diode element CCR2 and regulating terminal of a zener diode CCR1 the cathode of which is connected to ground The other side of resistive element CR8 is connected to the anode of a diode element CCR6, the cathode of which is connected to one of a resistive element CR9 and to the MUX3 terminal of the chip CU1. The cathode of the diode CCR2 is connected to the collector of a transistor CQ1, one side of a resistive element CR47, one side of a capacitive element CC10, and one side of a resistive element CR13. The other side of resistive element CR13 is connected to one side of a capacitive element CC14, the VA terminal of the chip CU1, and to the base of transistor CQ1. The other side of resistive element CR9 is connected to one side of a capacitive element CC6, one side of a resistive element CR10, the other side of capacitive element CC14, and ground. The other side of capacitive element CC6 is connected to the MX0 terminal of the chip CU1 which internally is connected to an A-to-D converter designated "A/D". The other side of resistive element CR10 is connected to one side of a resistive element CR11 and to the VADJ terminal of the chip CU1. The other side of resistive element CR11 is connected to the VREF terminal of the chip CU1. The terminal PD6 of the chip CU1 is designated "LINE MIMIC". The terminal PD7 of the chip CU1 is interconnected with ground and the GND terminal of the chip CU1. The VDD terminal of the chip CU1 is connected to provide the power supply voltage VDD as described previously and is connected to the emitter of previously described transistor CQ1, one side of capacitor CC4, one side of resistive element CR27, and to the $\overline{IRQ}$ terminal of chip CU1. The other side of capacitive element CC4 is connected to ground. The other side of resistive element CR27 is connected to one side of a capacitive element CC7, to the RESN terminal of the chip CU1, and to one input terminal of an integrated circuit CU3. The other side of resistive element CR47 is connected to the anode of a zener diode CCR3 and to another terminal for the chip CU3. The ground terminal of chip CU3, the anode of the zener diode CCR3, and the other side of the capacitive element CC7 are connected to ground. Connected between the OS2 and OS1 terminals of the chip CU1 is a resistive element CR19.

The terminal MUX5 of the chip CU1 is connected to one side of a resistive element R36 and is designated "POWER DOWN SENSE". Terminal PC4 of the chip CU1 is connected to one side of a resistive element CR30 and is designated "POWER DOWN SAVE". The other side of resistive element CR30 is connected to the other side of resistive element CR36, to one side of a resistive element CR31, and one side of a capacitive element CC11. The other side of capacitive element CC11 and the other side of resistive element CR31 are connected to ground Terminal PC2 of chip CU1 is designated "NC". Terminal PC3 of chip CU1 is designated "RELAY OUT". Terminal PC5 of chip CU1 is designated FET DRIVE, and as was described previously, is interconnected as an input to one side of a resistive element CR26.

CONSTRUCTION FEATURES OF THE COMMUNICATION MODULE 200

Referring now to FIG. 9 and FIGS. 11A–11D, there is shown a circuit board layout and circuit schematic diagram, respectively, for the communication module 200, otherwise depicted in FIG. 1. The communication module 200 which may be otherwise known as a smart minicomputer or PONI "PRODUCT OPERATED NETWORK INTERFACE" may act as an interface device between a remote personal computer PC and the electrical contactor 10, relay, etc., as the case may be. In this embodiment of the invention there are provided three rotary switches MSW1, MSW2, MSW3 representing the least significant address, the middle address, and the most significant address, respectively, for external access to the device 10 from a data highway, for example. Inputs MC2, MC5 of each of the aforementioned switches are grounded. The hexadecimal outputs "1", "2", "4", "8" for each switch, respectively, are provided to INCOM communication chip MU4 the INCOM chip is proprietary to the Westinghouse Electric Corporation and is further described in U.S. Pat. No. 4,644,547, issued Feb. 17, 1987 to L. C. Vercellotti et al. and entitled, "Digital Message Format for Two-Way Communication and Control Network". U.S. Pat. No. 4,644,547 is incorporated by reference herein. In this embodiment of the invention, INCOM chip MU4 operates in the expanded mode slave configuration. For the output of switch MSW1, the "1" output is provided to the A0 input of the chip MU4. The "2" output is provided to the A1 input, the "4" is provided to the A2 input, and the "8" is provided to the A3 input. In a like manner, for switch MSW2 the "1", "2", "4", "8" outputs are provided to the A4, A5, A6, A7 inputs of the chip MU4. Finally, for the switch MSW3 the "1", "2", "4", "8" outputs are provided to the A8, A9, A10, A11 inputs, respectively, of the chip MU4. The RX input and TX output of the communication chip MU4 are connected with complementary inputs and outputs of other portions of the communication module 200 in a manner which will be described hereinafter. Signal MRX is provided to the RX input and signal MTX comes from the TX output. There is provided a capacitor element MC1 one side of which is grounded and the other side of which is connected to the OSC1 input of the chip MU4, one side of a crystal MY1, and one side of a resistive element MR1. The other side of the crystal MY1 and the other side of the resistive element MR1 are connected to the OSC2 input of the communication chip MU4 and one side of a capacitive element MC4, the other side of which is grounded. The crystal MY1 may, in one embodiment of the invention, be a 3.6864 MHz crystal. The BUSY output of the communication chip MU4 is connected to the PA4 input of a microprocessor MU3. Microprocessor MU3 may be a Motorola chip of the type designated MC6805. The INT output of the communication chip MU4 is connected to the PA3 input of a microprocessor MU3. The SERDAT terminal of the communication chip MU4 is connected to the terminal PA2 of the microprocessor MU3. The SCRCLK terminal of the communication chip MU4 is connected to the PA1 terminal of the microprocessor MU3 and the R/W terminal of the communication chip MU4 is connected to the PA0 terminal of the microprocessor MU3. The VDD terminal of the communications chip MU4 is connected to the MVDD power supply voltage from power supply module 202 for power and to one side of capacitive element MC3. The other side of the capacitive element MC3 is connected to ground. The terminal PB0 of the microprocessor MU3 is connected to one side of a resistive element MR19 and one side of a resistive element MR20. The other side of the resistive element MR19 is connected to ground and the other side of the resistive element MR20 is connected to the MVDD voltage. All of the following terminals in the microprocessor MU3 are connected to ground PA7, PA6, PA5, PB3, PB4, PB5, PB6, PB7, VSS, PC7, PC6, PC5, PC4, PC3, PC2, PC1, PC0. The following terminals of the microprocessor MU3 are connected together, to one side of a capacitive element MC12, and to the MVDD power supply voltage: VPP, $\overline{\text{IRQ}}$, VDD, TCAP, PD7, SS, RD1. The $\overline{\text{RESET}}$ terminal of the microprocessor MU3 is connected to receive a RESET signal from power supply module 202 in a manner to be described hereinafter. There is provided a capacitive element MC11, one side of which is connected to or ground, and the other side of which is connected to one side of a crystal MY3, one side of a resistive element MR3, and to the OSC1 terminal of the microprocessor MU3. The other side of the crystal MY3, the other side of the resistive element MR3, and one side of a capacitive element MC5 are connected to the OSC2 input terminal of the microprocessor MU3. The other side of the capacitive element MC5 is connected to system common or ground. Terminals TCMP and TD0 of microprocessor MU3 are not externally connected. The SCK terminal of the microprocessor MU3 is connected to one side of a resistive element MR7. The MOSI terminal of the microprocessor MU3 is connected to one side of a resistive element MR5. The MIS0 terminal of the microprocessor MU3 is connected to one side of a resistive element MR8 and one side of a resistive element MR4, the other side of which is grounded. The other side of the resistive elements MR5, MR7, MR8 are connected to the DO, CLK, DI terminals of a connector MJ2.

INPUT NETWORK 201

Figure 11A:
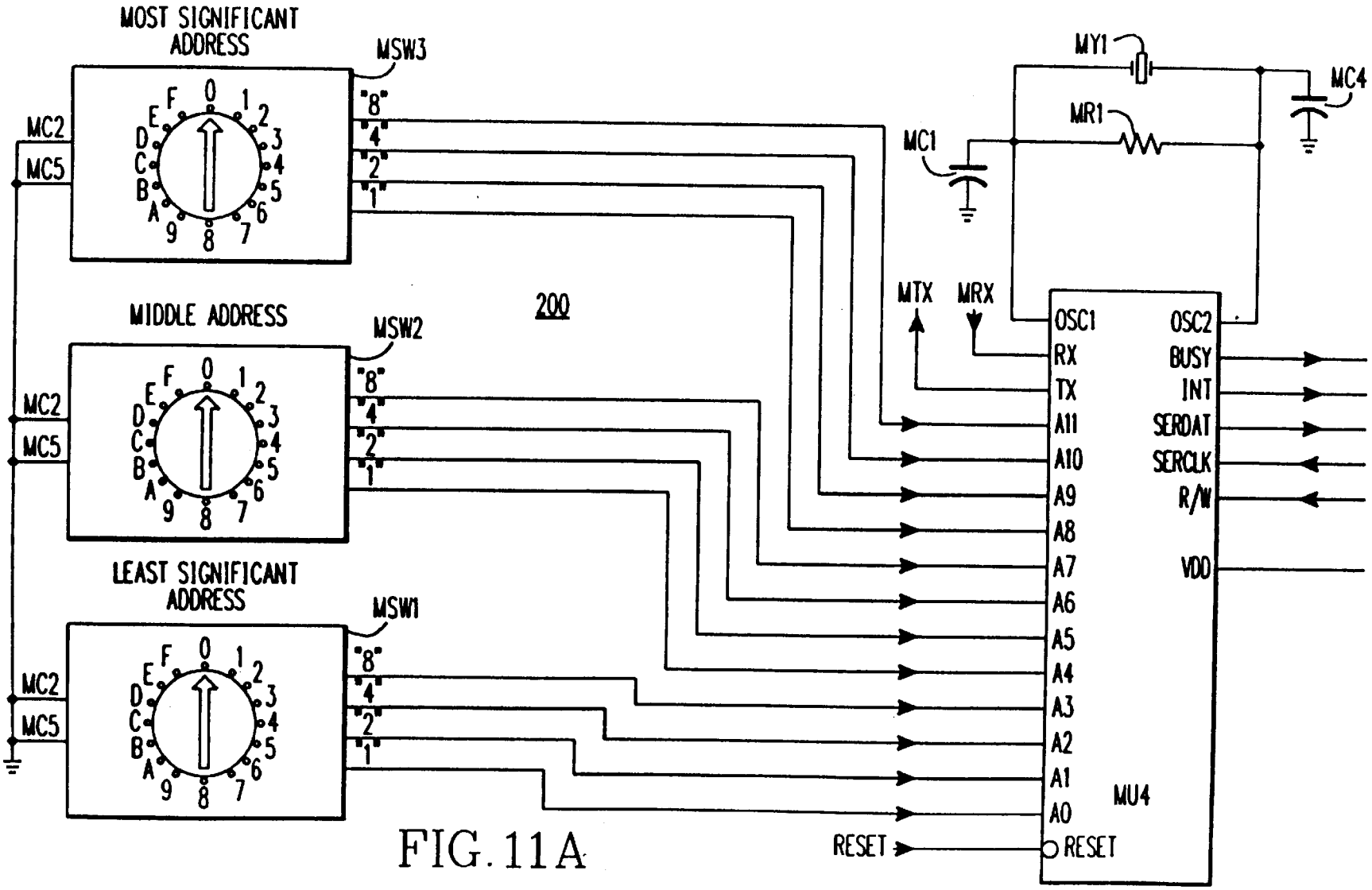
FIGS. 11A–11D show a circuit schematic diagram of the communication modules shown in FIGS. 1, 5 and 9.
Figure 11B:
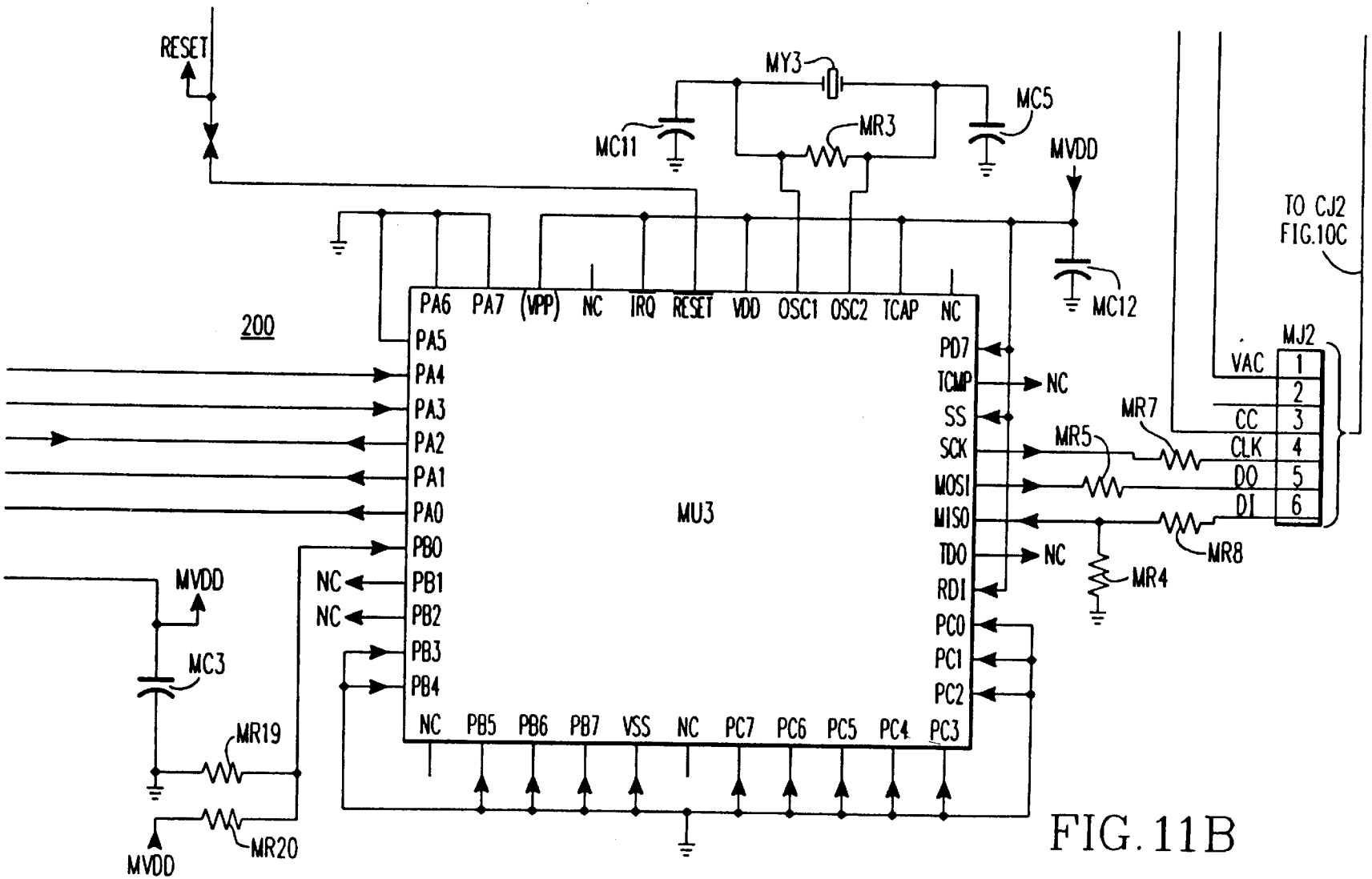
Figure 11C:
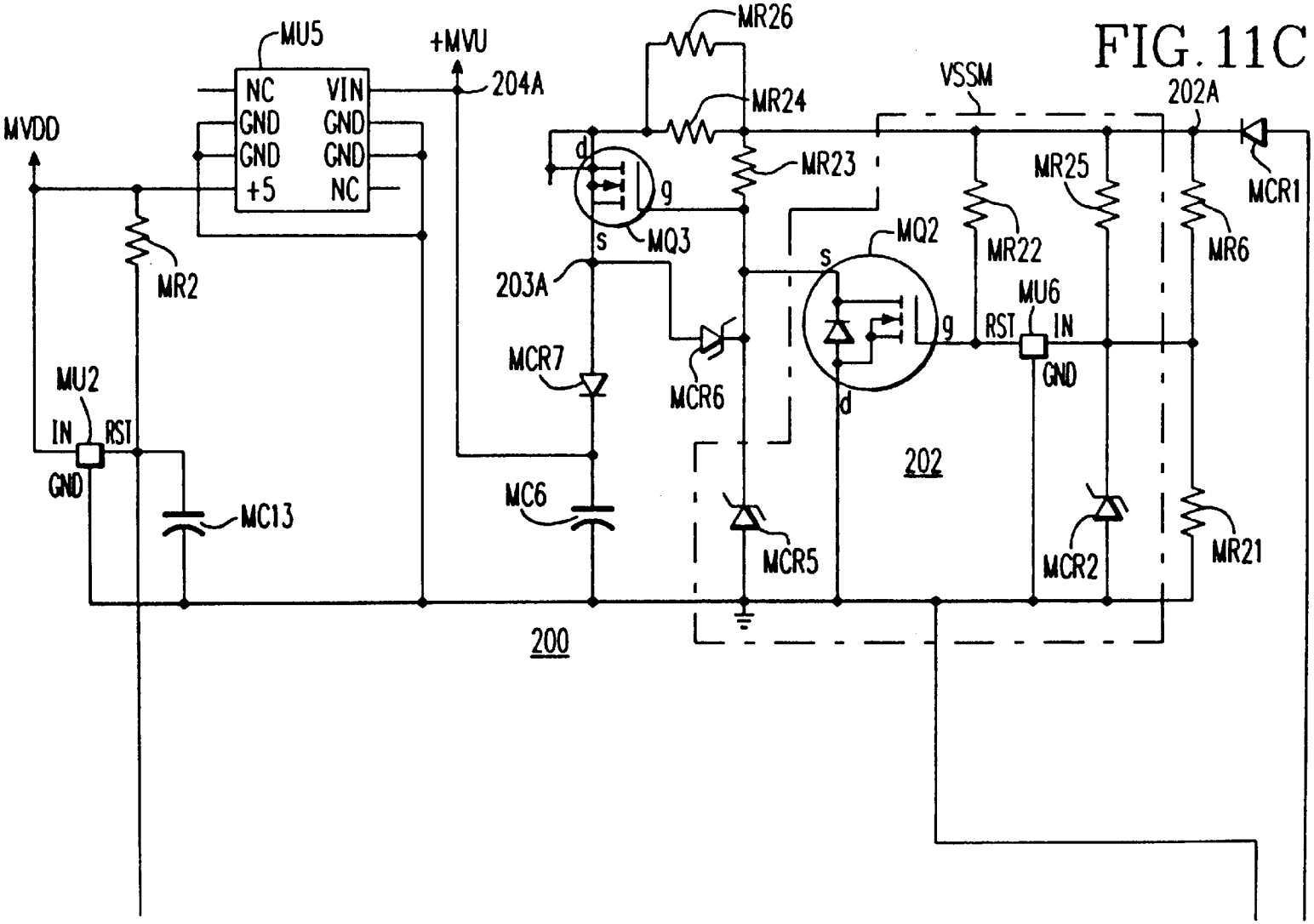
Figure 11D:
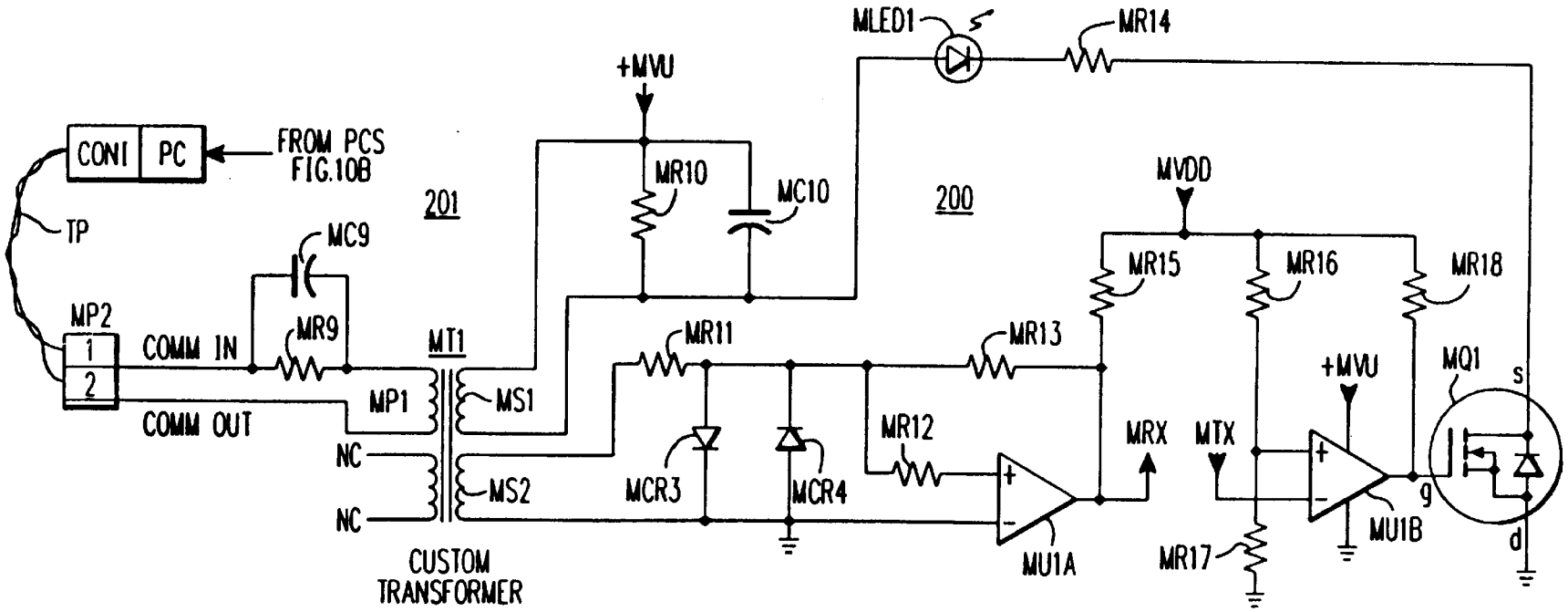

Referring specifically to FIG. 11D, there is provided an input network for module 200 which includes an input port or connector MP2. Terminal 1 of input connector MP2 is connected to one side of a resistive element MR9 and one side of a capacitive element MC9. The input terminal 1 of the connector MP2 is designated "COMM IN". The other side of capacitive element MC9, and the other side of resistive element MR9 are connected to one side of a first primary winding MP1 of a transformer MT1. Terminal 2 of connector MP2 is connected to the other terminal of the transformer winding MP1 of the transformer MT1. Terminal 2 of connector MP2 is designated "COMM OUT". The secondary windings of the transformer MT1 are designated MS1 and MS2. Connected in parallel across the secondary winding MS1 are resistive element MR10 and a capacitive element MC10. Connected to the high side of the capacitive element MC10 is a voltage MVU which is provided from a power supply which will be described hereinafter. Connected to one side of the secondary winding MS2 is one side of a resistive element MR11, the other side of which is connected to the anode of a diode MCR3. The cathode of the diode MCR3 is connected to the other side of the transformer secondary winding MS2. Connected in parallel with a diode MCR3 is a second diode MCR4 connected in an anode-to-cathode, cathode-to-anode relationship. Connected to the anode of the diode MCR3 is one side of a resistive element MR12 and one side of a resistive element MR13. The other side of a resistive element MR12 is connected to the positive input terminal of a isolating comparator MU1A. The negative input terminal of the comparator MU1A, the anode of the diode MCR4, and the cathode of the diode MCR3 are connected to ground. The other side of the resistive element MR13 is connected to the output of the comparator MU1A and to one side of a resistive element MR15. The output of the comparator MU1A provides the MRX signal for the chip MU4 as described previously. The other side of the resistive element MR15 is connected to one side of a resistive element MR16, one side of a resistive element MR18, and to voltage MVDD. The other side of the resistive element MR16 is connected to the positive input terminal of a comparator MU1B and to one side of a resistive element MR17. The negative terminal of the comparator MU1B receives the MTX output signal from the chip MU4 as described previously. The comparator MU1B is interconnected with the voltage source MVU from power supply 202 and with ground in an appropriate manner. The output of the comparator MU1B is connected to the other side of the resistive element MR18 and to the gate of a Field Effect Transistor (FET) device MQ1. The drain of the transistor device MQ1 is connected to ground as is the other side of the resistive element MR17. The source of the transistor device MQ1 is connected to one side of a resistive element MR14, the other side of which is connected to the cathode of a light-emitting diode MLED1, the anode of which is connected to common terminal between the previously described resistive element MR10, and capacitive element MC10.

POWER SUPPLY CIRCUIT 202

Referring specifically to FIGS. 11B and 11C, there is shown connected to the MJ2 connector a conductor designated VAC which is provided to the anode of a diode MCR1. The cathode of the diode MCR1 is connected to one side of a resistive element MR6, one side of a resistive element MR25, one side of a resistive element MR22, one side of a resistive element MR23, one side of a resistive element MR24, and one side of a resistive element MR26. The other side of resistive element MR6 is connected to one side of a resistive element MR21, the cathode of a zener diode MCR2, the other side of resistive element MR25, and the terminal IN of a RESET MU6. RESET device MU6 and RESET device MU2 to be described hereinafter may be Motorola devices designated MC34064. Terminal RST of RESET device MU6 is connected to the other side of resistive element MR22 and to the gate terminal of a transistor MQ2. Elements MR22, MR25, MCR2, MCR5, MQ2 and MU6 form a voltage sensing and switching means as described hereinafter. The drain terminal of the transistor MQ2 is connected to the other side of the resistive element MR23, the gate terminal or control of a FET MQ3, the cathode or regulating terminal of the zener diode MCR6, and the cathode or regulating terminal of a zener diode MCR5. The other side of resistive elements MR24, MR26 are connected together and to the drain or input terminal of the FET MQ3. The source or output terminal of the transistor MQ3 is connected to the anode of the zener diode MCR6 and the anode of a diode MCR7. The cathode of the diode MCR7 is connected to one side of a capacitive element MC6 and to provide the output voltage MVU. There is provided a voltage regulator MU5, the VIN input terminal of which is also connected the voltage MVU. There is a "+5" terminal for the device MU5 which is connected to one side of a resistive element MR2 and the IN terminal of a RESET device MU2. This later terminal provides the voltage MVDD. The RST terminal of the device MU2 is connected to the other side of the resistive element MR2, to one side of a capacitive element MC13, and to the previously described $\overline{\text{RESET}}$ terminal of the microprocessor MU3 for providing a RESET signal thereto connected. Four terminals designated GND on the device MU5 are connected to ground. In a like manner, the other side of resistive element MR21, the anode of the zener diode MCR2, the GND terminal of the device MU6, the drain of the transistor element MQ2, the anode of the zener diode MCR5, the other side of the capacitive element MC6, the other side of the capacitive element MC13, and the GND terminal of the device MU2 are connected to ground.

OPERATION

Referring to FIGS. 10A and 10B, explanation of the operation of the preferred embodiment of the invention is begun. Terminal 4 otherwise designated "C" of connector CJ1 is internally connected to ground. This terminal is interconnected externally with the user's ground. Connected to terminal 1 externally of connector CJ1 is a customer's pushbutton or similar initiating device which provides the output signal "3" which is indicative of a start operation. This is supplied to terminal CP2 of chip CU1 in order to begin operation. Connected externally to terminal 2 of terminal CJ1 is a "P" signal which is indicative that it is "permissible" to utilize the contactor circuit. This may be referred to as an ENABLE signal which is supplied by the user. Finally, connected to terminal 3 is the user's control voltage which, in a preferred embodiment of the invention, may be 120V AC. This latter voltage is designated "E". Varistor CMV1 operates in conjunction with filter network CR3, CC3 to provide the control signal "E". Resistors CR29, CR35 operating in parallel cooperate with resistor CR2 and capacitor CC2 provide the filtered signal "P". Resistive elements CR34, CR28 operating in conjunction with resistive element CR1 and capacitive element CC1 provide a filtered input for the "START" signal. The "START" signal is supplied to the chip CU1 by way of voltage divider CR1, CC1, to the CP2, PC1 inputs of the microprocessor CU1, to indicate a start operation is to begin. Enable or permission signal "P" is supplied to the microprocessor CU1 by way of the voltage divider created by the resistive elements CR2, CC2 and provides an input signal to terminals CP1 and PC0 of the chip CU1 to indicate that it is permissive to utilize the chip.

With attention to FIG. 10B, a method for closing and opening the contacts of the contactor 10 is taught. In particular there is provided, as is shown in FIG. 3 for example, the coil COIL SC for moving the member 42 for thus causing the bridging member 44 to move in such a direction as to cause the contacts 22, 26, 46, 48 to close in the manner described previously, or to open in the manner described previously, depending upon where energy is supplied to the coil COIL CS or not. Energy may be supplied to the coil COIL CS in any convenient controllable fashion, but in a preferred embodiment of the invention it is provided by way of interconnection with the control voltage "E" as actuated by a signal designated FETDRIVE going positive as a function of action within the chip CU1. The diodes CCR10, CCR11, CCR12, CCR13 provide a full-wave bridge rectifier for the AC voltage "E" as interconnected between terminal 3 and terminal 4 of connector CJ1. This voltage is impressed across the combination of the resistive element CR15 and the zener diode CCR5 to provide a controlled voltage for the collector of the output of the transistor of the optocouple transistor network CU2. Normally, if the FETDRIVE signal is zero, the diode portion of the optocoupler or input circuit thereof remains unenergized, and the transistor output allows the base of the transistor CQ3 to assume a sufficient value of current and voltage to allow the base of the transistor CQ4 to place transistor CQ4 in an open circuit disposition between the collector and emitter thereof. However, if the FETDRIVE output signal is present, the diode of the optocoupler CU2 is energized, thus providing energizing light to the base of the transistor output thereof, thus causing the transistor CQ3 to conduct in such a manner as to cause the transistor CQ4 to assume a short circuit disposition between the emitter and collector thereof, thus providing the full voltage "E" between the terminals 1 and 2 of the connector CJ3 and across the diode CCR4. This causes the coil COIL CS to conduct electrical current, thus causing the contacts of the aforementioned contactor to close, thus providing a path for current through the aforementioned contactor.

Referring to FIGS. 10B, 10A, it will be noted that the presence of the voltage "E" will cause the voltage divider-filter represented by the resistive element CR3, and capacitive element CC3 to provide an input signal to the CPO input of the chip CU1 by way of conductor LINE SENSE, thus indicating that line voltage is present and that any operation within the chip CU1 or outside thereof which depends upon the presence of that voltage is allowable. In a like manner, resistive element CR17 will conduct some of the current which flows through the coil COIL SC when the coil is energized, thus providing an input indication back by way of the COIL I SENSE line to the filter represented by resistive element CR7 and capacitive element CC12. The midpoint of this filter element is interconnected with the MUX4 input terminal of the chip CU1, thus indicating that current is flowing in the coil, thus providing an implied input that the contactor contacts are closed.

Coils CL1A, CL1B, CL1C are interconnected at one end thereof to ground. These coils sense phase current flowing in phases A, B, C, or 1, 2, 3, as the case may be, of a three-phase electrical power system which is interconnected with the contacts of the aforementioned contactor. These coils provide analog current information to the chip CU1 by way of input terminals MUX0, MUX1, MUX2 for PHASES 1, 2, 3, respectively.

In order to generate the voltage +VU1, it is necessary to take the 120V control voltage "E" and capacitively couple it to generate the appropriate voltage. Capacitor CC8 performs this function. The resistive element CR44 is a discharge resistor which will discharge the capacitor CC8 in the event of a loss of power. Resistive element CR12 and resistive element CR46 together act as a parallel current-limiting resistive network. Zener diode CCR1 clips the voltage to a usable value which in the preferred embodiment of the invention is approximately 15V. Diode CCR2 is a half-wave rectifier and resistive element CR13 and capacitive element CC10 act as a filter. Capacitive element CC10 is a charge filter. The voltage +VU1 is therefore generated at the junction point between the resistive element CR13 and capacitive element CC10. Voltage +VU1 then cooperates with resistive element CR13 in combination with capacitive element CC14 and transistor CQ1 to create a 5V power supply. This value is designated CVDD and it exists at the emitter of transistor Q1 and is supplied to the CVDD terminal of the chip CU1. Voltage CVDD cooperates with capacitive element CC4 and resistive element CR27 to create a RESET network. This RESET network cooperates with the RESN input terminal of the chip CU1. If the voltage VDD becomes noisy, thus creating a possibility that the chip CU1 will operate in an erratic manner, the RESET network will reset the chip CU1 at terminal RESN. Element CU3 is part of an undervoltage reset. If the voltage CVDD is above 4.5V, it will operate to pull the voltage up toward 5V at the top of capacitive element CC7. If voltage VDD is below 4.5V, the chip CU1 will be reset by way of the reset network RESN. Zener diode CCR3 protects the input to the regulator circuit CU3 so that the voltage impressed thereacross does not get larger than a predetermined value which, in a one embodiment of the invention, is about 5.6V. Resistive element CR19 which is interconnected with terminals OS1, OS2 of the chip CU1 sets the frequency at which chip CU1 oscillates. Resistive elements CR10, CR11 form a trim circuit which is utilized to set the VADJ (V adjust) and VREF (V reference) capabilities of the chip CU1. In one embodiment of the invention, resistive elements CR10, CR11 are not adjustable.

Referring now to FIG. 10C, the power-down circuit will be described. An amount of electrical charge is stored in capacitive element CC1 that is in proportion to the amount of heat in the motor controlled by the contactor or motor control device 10. There is stored internally in the chip CU1 a model for what the heat of the motor will be as a function of input variables such as motor current. The electrical charge is supplied by way of terminal PC4. There is also provided a POWER DOWN SENSE line which is connected to terminal MUX5 of chip CU1. It utilizes the voltage on capacitor C11 to decide how hot the motor was when power was lost. There is also provided a REMOTE RESET SENSE line in which resistive element CR20 and resistive element CR32 cooperate with the RR signal on terminal 7 of connector CJ2. These, in conjunction with resistive element R21, can provide a remote electrical reset and indication. Switch element CSW3 is a reset switch. When the contactor 10 has been tripped and switch CSW3 is actuated, the entire unit will be reset and be prepared to run again. Capacitive element CC13 and resistive element CR24 act as a noise filter for the communications channel or terminal designated DI. Likewise, resistive elements CR23, CR33 and capacitive element CC5 act as a noise filter for the clock channel CLK. Switch CSW2 in conjunction with its various terminals and the associated pulldown resistive resistors CR37 through CR43 is an option setting switch, whereby the user can throw certain parts of the switch to indicate heater settings, motor size, etc for programming chip CU1.

Referring now to FIGS. 11A–11D, the operation of the communications module 200 will be described. In particular, there is provided a connector MP2 which represents the first stage of the input network 201 for the communications device 200. Connector MP2 is interconnectable with a communications interface CONI "computer operated network interface" in a remote personal computer PC in a manner which will described hereinafter. Terminal 1 of connector MP2 interconnects with the line designated COMM IN which feeds through the capacitive element MC9 and a resistive element MR9, which operate as a filter. There is provided transformer MT1 having the one side of the primary winding MP1 thereof connected to COMM IN line and the other side thereof connected to the COMM OUT line which, in turn, is connected to terminal 1 of connector MP2. The pair of secondaries MS1, MS2 for transformer CT1 interact with the remaining part of the communications module 200. Resistive element MR11 is a current-limiting element and diodes MCR3, MCR4 are clipping diodes. The result of the action of the clipping diodes MCR3, MCR4 is to take the AC signal which is provided by the secondary winding MS2 of the transformer MT1 and clip the voltage to near zero in both the positive and negative direction. Resistive element MR12 feeds the positive terminal of the comparator MU1A, the negative terminal of which is grounded. The output terminal of the comparator MU1A provides the output signal MRX. Comparator MU1A basically operates as a squaring device, which ensures that the signal MRX has an acceptable square wave shape. Resistive element MR13 provides hysteresis for the comparator MU1A so that it does not oscillate about a single value. Resistive element MR15 is a pull-up resistor; that is because the output of the comparator MU1A is of the open collector variety. There is also provided a similar comparator MU1B which has available to the negative terminal thereof the signal MTX, which will be described more fully hereinafter. Signal MTX is either a 5V or a 0V signal. Resistive elements MR16, MR17 are bias resistors which place a bias of approximately 2.5V on the positive terminal of the comparator MU1B. Resistive element MR18 is a pull-up resistor similar to resistive element MR15. When the output of the comparator MU1B is high or at a digital 1, the field effects transistor MQ1 is energized or turned on, thus drawing electrical current through current-limiting resistive element MR14, and through the light-emitting diode element MLED1. Energization of the light-emitting diode element MLED1 is an indication to the user that the entire unit is, in fact, in a transmitting mode. Resistive element MR10 and capacitive element MC10 merely act in combination as a noise filter. Field effects transistor MQ1 is an oscillating device, and when it is turned on it provides an oscillating AC signal which generates a signal across the transistor secondary MS1 for application to the communications network represented by the lines COMM IN and COMM OUT. This is true even though the signal MTX is an ON/OFF type DC signal. Consequently, element MQ1, which may be a metal oxide FET transformer is a modulator. On the other hand, the operation of the input circuit represented by resistive element MR11, diodes MCR3, MCR4 and resistive elements MR12, MR13, MR15 and comparator MU1A act as a demodulator network.

Attention is now called to the rotary switches MSW1, MSW2, MSW3 of FIG. 11A. Basically, these switches provide address information for the entire network. It does this by providing a digital code to the INCOM chip MU4. Once the INCOM chip MU4 has its address, when a signal MRX is delivered to the INCOM chip MU4 by way of the input network 201 previously described, the INCOM chip MU4 scans the address information provided in part of the transmission from terminal MRX and decides whether the INCOM chip has been properly addressed or not. If the INCOM chip has been properly addressed in compliance with the address information provided by the switches MSW1 through MSW3, the INCOM chip MU4 will operate to receive further information from the communication network and provide useful functions such as motor starting. Obviously, address information is provided from the switches MSW1 through MSW3 by way of the twelve lines interconnected with the input terminals A0 through A11 of the INCOM chip MU4. The RX and TX terminals which interconnect with the MRX and MTX signals, respectively, of the input circuit 201 as described previously are shown on the INCOM chip MU4. INCOM chip terminals OSC1 and OSC2 are interconnected with a well-known oscillator circuit arrangement comprising capacitive elements MC1, MC4, resistive element MR1, and crystal MY1. Capacitive element MC3 which is interconnected between ground and the combination of the input terminal VDD and the power supply voltage CVDD is merely a bypass capacitor. Resistive elements CR19, CR20 provide a voltage divider between ground and voltage VDD. The voltage divider point of the latter network is connected to the PBO input of the microprocessor MU3 for the purpose of preventing a user from effectuating commands into the microprocessor CU3, which are undesirable. It is therefore a disabler of certain microprocessor commands.

Referring additionally to FIG. 11B, terminals PA0 through PA4 of the microprocessor MU3 are interconnected with the R/W, SCRCLK, SERDAT, INT, and BUSY terminals of the INCOM chip MU4, respectively. Terminals BUSY and INT provide information to the microprocessor MU3, the BUSY terminal telling the microprocessor when not to communicate with the INCOM chip and the remainder of the communications network under certain circumstances and the INT terminal telling the microprocessor when to communicate. Terminal R/W is a READ/WRITE terminal whereby the INCOM chip MU4 is alerted whether it is to write information to the microprocessor MU3 by way of the serial data line SERDAT or to read information from the microprocessor MU3 by way of the serial data line SCRDAT. The serial clock line SCRCLK is a pulsing or clocking network for the INCOM chip MU4 under the command of the microprocessor MU3. Basically, data provided to the INCOM chip MU4 by way of the input terminal RX or taken from the input chip MU4 by way of the output terminal TX is transmitted back and forth by way of this serial data line SCRDAT to and from the microprocessor MU3. Consequently, INCOM data from the external personal computer PC which comes into the input network 201 by way of connector MP2 is properly demodulated and sent to the INCOM chip MU4 by way of terminal RX, and fed from the INCOM chip MU4 to the microprocessor MU3 by way of the serial data line SERDAT. Outgoing digital information from the microprocessor MU3 traverses the serial data line SCRDAT in the opposite direction, is routed by way of the INCOM chip CU4 to the terminal TX, and thence to the input network 201 where it is modulated and provided to the personal computer PC as an output by way of the connector MP2. The terminals SCK, MOSI, MISO of microprocessor MU3 are interconnected to the connector MJ2 and from there to complementary terminals on the connector CJ2 of the electronic circuit board 128 as described previously with respect to FIG. 10C, the complementary terminals being shown to the extreme right on FIG. 10C. The aforementioned connectors MJ2 and CJ2, and the lines or cables connected therebetween, represents the main communication path between the microprocessor MU3 and the chip CU1. The clock signal which is provided by way of terminal SCK to line CLK for terminal MJ2 is always generated in the microprocessor MU3. Consequently, the microprocessor MU3 represents a master and the chip CU1 represents a slave as far as the clock signal CLK is concerned. Data is transferred back and forth between microprocessor MU3 (master) and chip CU1 (slave) by the MOSI (master out/slave in) line, and the MISO (master in/slave out) line, or terminals of the microprocessor MU3.

POWER SUPPLY 202

Figures 13A, 13B, 13C:
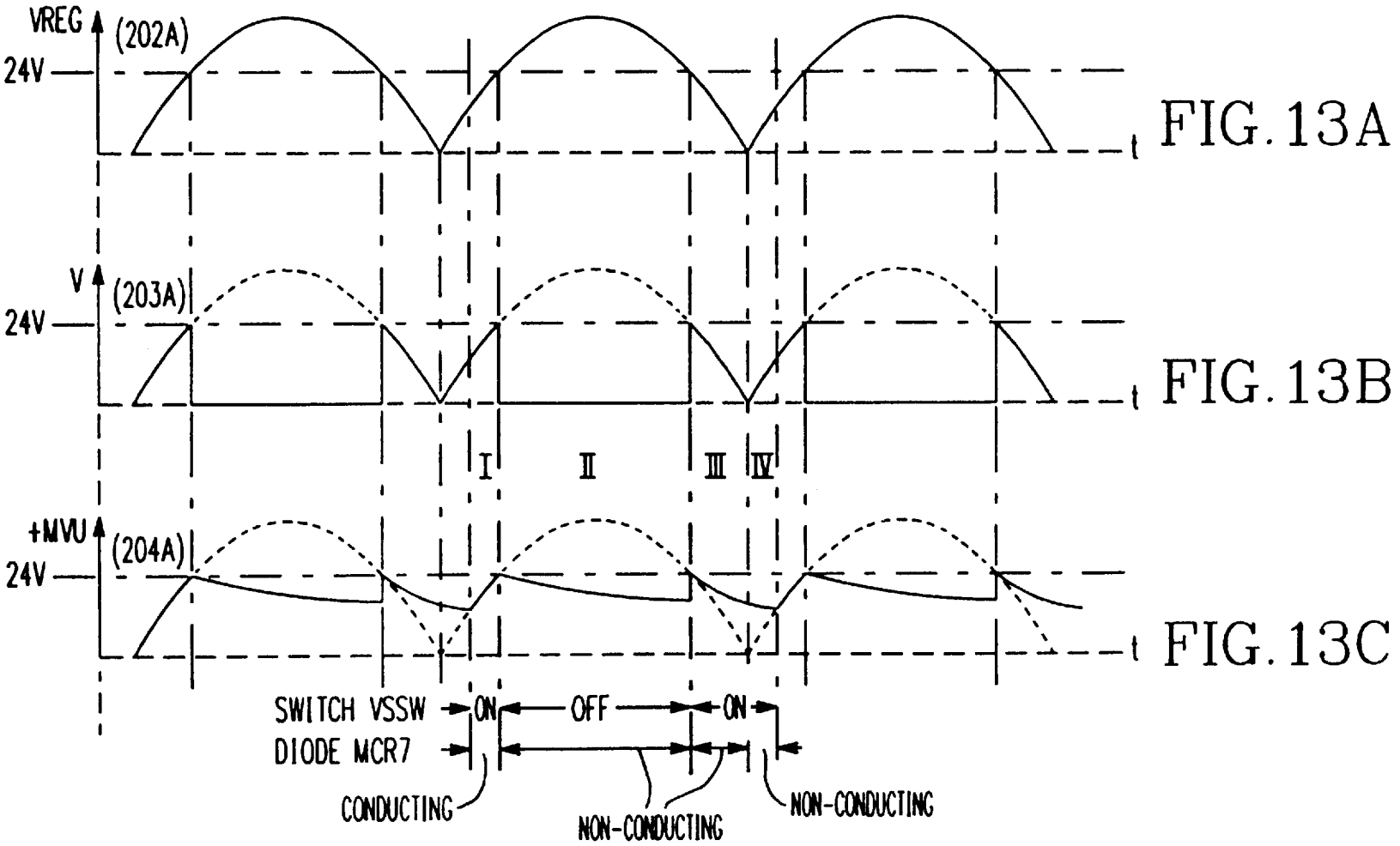
FIGS. 13A–13C shows plots of power supply voltage at various locations for the power supply 202 of the communications module 200.

Referring specifically to FIGS. 11C and 13A–13C, a pseudo switching power supply 202 is taught. In particular, AC power is delivered to the power supply 202 by way of the connector MJ2 at terminals 1, 2 thereof (see FIG. 11B). The AC power is delivered between the lines VAC and CC from complementary lines on terminal 1 and 3 of connector CJ2. One of the advantages of the present invention lies in the fact that the AC voltage applied as described may range from a very low value to as high as 200V. The AC voltage is voltage "E" as shown in FIGS. 10A and 10C. Diode element MCR1 half-wave rectifies the input voltage as shown at Point 202A and in waveform 202A in FIG. 13A. In one embodiment of the invention it is desirable to produce 24V as an output voltage MVU, and therefore the 24V line is shown in FIG. 13A although that is not limiting. In the present embodiment of the invention, resistive elements MR6, MR21 are chosen to produce the ultimate voltage wave shape at MVU as depicted in FIG. 13C. Zener diode element MCR2 clips the voltage between resistive elements MR25 and MR21 at 5.6V to protect the low voltage reset device MU6 to thus limit the input voltage on terminal IN thereof to no more than 5.6V. Resistive element MR25 is a current-limiting resistor. Device MU6 is a "low voltage" reset device which may be of the kind designated as Motorola MC34064. The low voltage reset device MU6 is such that if the voltage on the input terminal IN thereof, relative to ground, is below 4.5V, the reset output terminal RST produces a zero output voltage to ground; whereas, on the other hand, if the voltage on the input terminal is above 4.5V, the reset output terminal RST produces approximately 4.5V to ground. Resistive element MR22 is a pull-down resistor element because device MU6 operates in the open collector mode. Field effects transistor device MQ2 acts as an inverter producing a signal opposite to the one at the RST output terminal of the device MU6. The voltage between the Drain and Source of transistor MQ2 oscillates or changes between zero and 15V DC. The 15V output is determined by the zener diode device MCR6. Field effects transistor device MQ3 acts as a series switch relative to the voltage produced at the cathode of the diode MCR1, i.e., the voltage at point 202A. The output voltage will be allowed to be imposed upon the source of field effects transistor MQ3 until a value of 24V is attained. At that point the action of the transistor MU6, MQ2 will cause the conduction path between the drain and the source of the field effects transistor MQ3 to open. The voltage at the drain will drop instantaneously to zero. This is shown as the voltage at point 203A in FIGS. 11C and 13. Diode MCR7 and capacitive element MC6 act as a filter so that the output voltage MVU at point 204A in FIGS. 11C and 13 is shown as a rather poorly regulated voltage MVU, which is approximately 24V. It is necessary to regulate this latter voltage to produce the value MVDD, which is a highly regulated 5V DC value in this embodiment of the invention. In order to accomplish that, a 5V regulator device MU5 is utilized. With the voltage wave shape MVU imposed on the "VIN" terminal of Device MU5, the output voltage at the "+5" terminal thereof is the highly regulated 5V DC value MVDD as shown.

The operation of the power supply circuit 202 is as follows. At the beginning of the Region I, switch VSSM is on and diode MCR7 is conducting. The half wave rectified voltage is above zero but less than 24V and is increasing towards 24V. Output voltage +MVU at 0.204A follows the rectified voltage VREC shown in FIG. 13A which exists at 0.202A. At the end of Region I, the half wave rectified voltage VREC reaches 24V and turns switch VSSM off. This immediately drops the voltage on the anode of the diode MCR7 to zero which causes that diode to cease conducting. During the period II, the switch VSSM is off and the diode MCR7 is nonconducting. The voltage +MVU is determined by the discharge characteristic of the capacitor MC6 discharging through the remainder of the circuit connected to the power supply terminal +MVU. This continues until the end of Region II, when the half wave rectifier voltage VREC shown in FIG. 13 drops below 24V. When this happens, switch VSSM immediately turns on, however, the diode MCR7 remains in a nonconducting state as the voltage on the anode thereof is less than the voltage on the cathode thereof which is represented by the decay characteristic of the capacitor MC6 as was described previously. It will be noted that the voltage on the anode of the diode decreases rapidly towards zero during Region III as it follows the wave shape VREC. The voltage on the cathode of the diode MCR7 is also decreasing but not as fast as the voltage on the anode. At the beginning of Region IV the capacitive element continues its discharge because the switch VSSM though still in a conducting or on state allows voltage to be impressed on the anode of the diode MCR7 which is increasing but nevertheless still less than the discharge voltage of the capacitor MC6. The end of Region IV is defined as that point where the increasing voltage VREC equals the decreasing voltage of the capacitive element MC6 in which case the cycle begins once again. Note that once the output voltage approaches the switch control voltage, the switch is automatically turned off, even if the voltage sense circuit has not been activated. This has the advantage of blocking the higher input voltages when charging and allowing the circuit to continue to conduct if not fully charged. It also acts as an internal phase angle controller.

Low voltage reset MU2, resistive element MR2, and capacitive element MC13 produce the signal RESET for microprocessor MU3. In particular, as long as the voltage across the resistive element MR2, which is connected across the IN-to-RST terminals of the device MU2, is above 4.5V, the RESET wave shape will be at 0V. However, if the latter-mentioned voltage across the resistive element R2 drops below 4.5V, the RESET value will step to a high value, which be sufficient to reset the microprocessor MU3. This will occur as a result of a voltage loss on the power supply 202 which would cause the activity of the microprocessor MU3 to no longer be considered reliable.

CALIBRATION TECHNIQUE

Referring now to FIGS. 10A–10C, 11A, 11B, 11D, 12, 14 and 15, the process for calculating a digital calibration factor for the electrical device 10 is described. In particular, the chip CU1 operating in conjunction with the remainder of the circuits of FIGS. 10, 11, senses an electrical variable such as but not limited to an electrical current IAIN by way of current sensors CL1A, CL1B, or CL1C, and provides that current to the chip CU1 by way of input terminals MUX0, MUX1, and MUX2, respectively. Sequentially, those input terminal are supplied by terminal MUX3 to an integrating capacitor or integrator CC6 for producing a voltage representative of the currents in each case. That voltage is then sequentially provided to an A/D converter through terminal MX0 and thence to memory locations IA0, IA1, IB0, IB1, IC0, IC1, in the chip CU1 for phase currents A, B, C, respectively.

Key elements of the process include an adjustable current source PCS and product hardware including analog signal processing circuitry and synchronous bidirectional serial communication link to an external computer PC (product serves as "master" for link).

The procedure assumes that the product microprocessor CU1 utilizes a gain correction factor for each analog input which is used to adjust the digitally processed values derived from the A/D converter output. Also it is assumed that for a time based calibration that the processor CU1 utilizes a timer "tick" derived from a programmable timer. The timer consists of a free running counter and an output compare register. Whenever a timer interrupt occurs, corresponding to the counter value equalling the compare register contents, the register is reloaded with the value required to produce the next equally spaced timer interrupt. The computation of this reload value involves a timer correction factor which can be used to adjust the time between timer interrupts. This can be used to correct for oscillator variations due to the use of an RC oscillator rather than a crystal.

Figure 12:
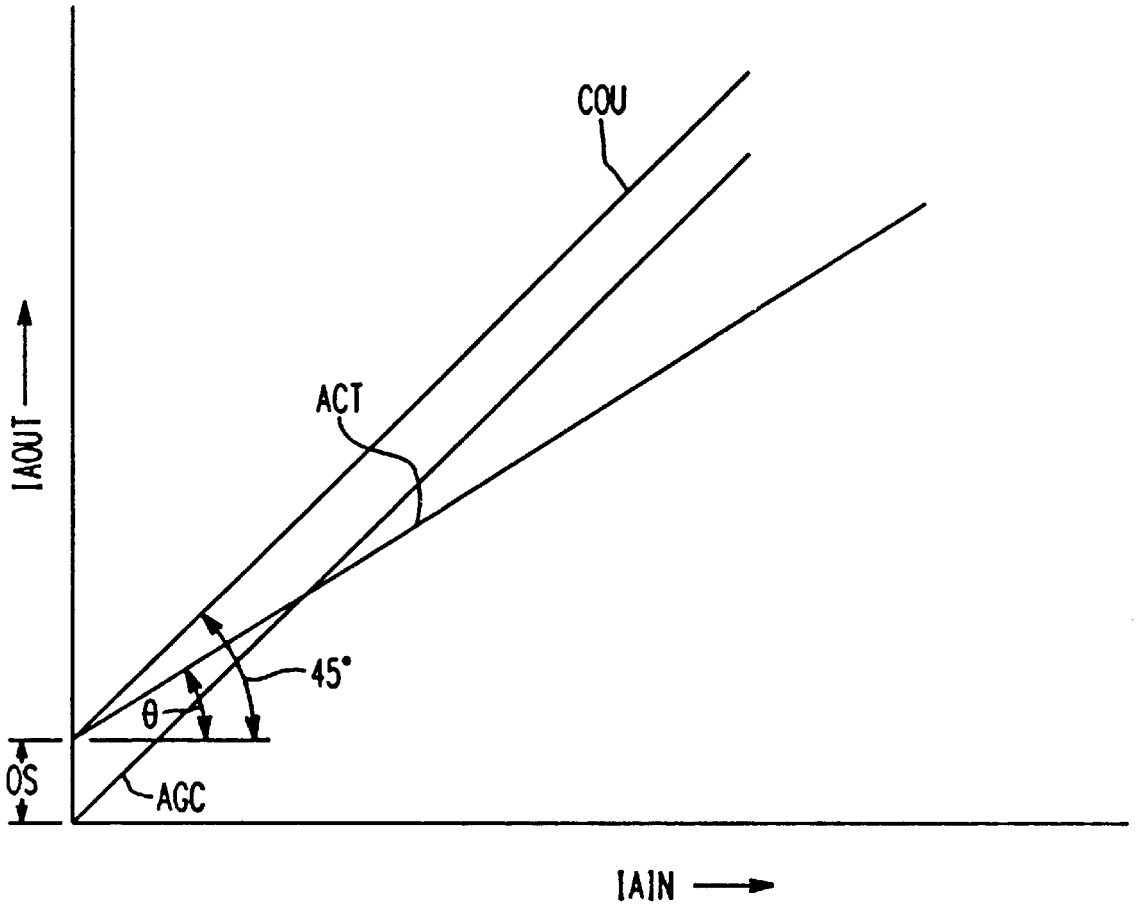
FIG. 12 shows a plot of input vs. output (or derived) current.

Referring to FIG. 12 specifically, it is recognized that for an ideal system, the actual current sensed IAIN in this case should equal the current as derived or interpreted by the chip CU1; IOUT in this case. In an ideal situation a graph representing the relationship between IAIN and IAOUT for equal scales on both ordinates should be a straight line at a 45° angular offset from the horizontal axis; that merely says that for any particular value of input current IAIN chosen, the output current IAOUT or derived current utilized in the microprocessor CU1 should be exactly the same. On the curve depicted in FIG. 12, that means that the angle j should be 45° and the offset OS should be zero. Therefore, the line designated AGC (assumed gain correction) should represent a slope of "1", which means that, as was stated previously, the input current will equal the output current. However, it is well recognized that the gain correction may not be ideal and, furthermore, offsets may exist. In this embodiment of the invention no correction is made for the offset OS. However, correction is made for gain error. This means that if, in actuality, the output current IAOUT does not equal the input current IAIN but rather is related to the input current IAIN by the straight line designated ACT (for actual current measurement), for example, that a gain correction can be made, which ignores offset OS but which nevertheless places the corrected line COU at a relationship of j=45° with respect to the horizontal axis of the graph of FIG. 12. This corrected output utilizes the generation or calculation of digital gain correction factors in this embodiment of the invention.

In order to calculate gain correction factors for electrical current, a remote personal computer PC designated PC may be interconnected with terminal MP2 by way of a twisted pair of conductors TP. The remote personal computer PC may be interconnected by way of a CONI card or module. A precision current source PCS is utilized to provide precision known currents in the lines A, B, C, which are measured or monitored by the current sensors CL1A, CL1B, CL1C, respectively. The precision currents generated by the precision current source PCS are also made available to the personal computer PC and is stored as a value in a memory portion thereof.

Figure 14:
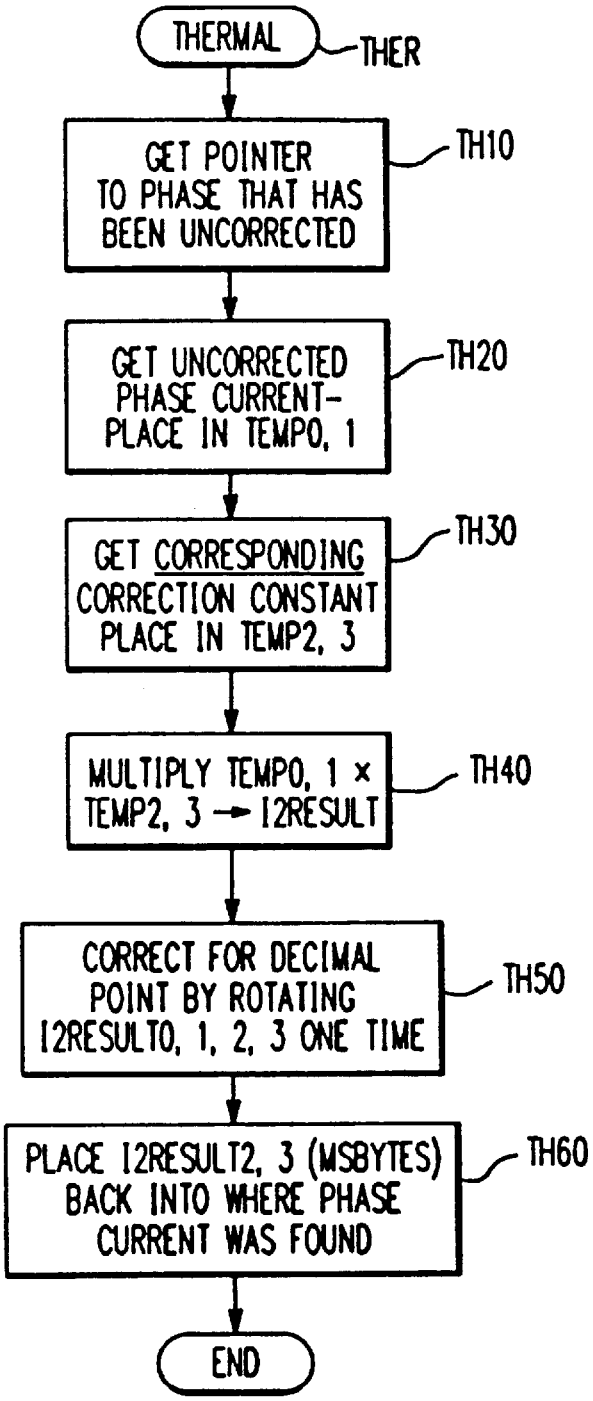
FIG. 14 shows a flow chart for reading circuit variables.
Figure 15:
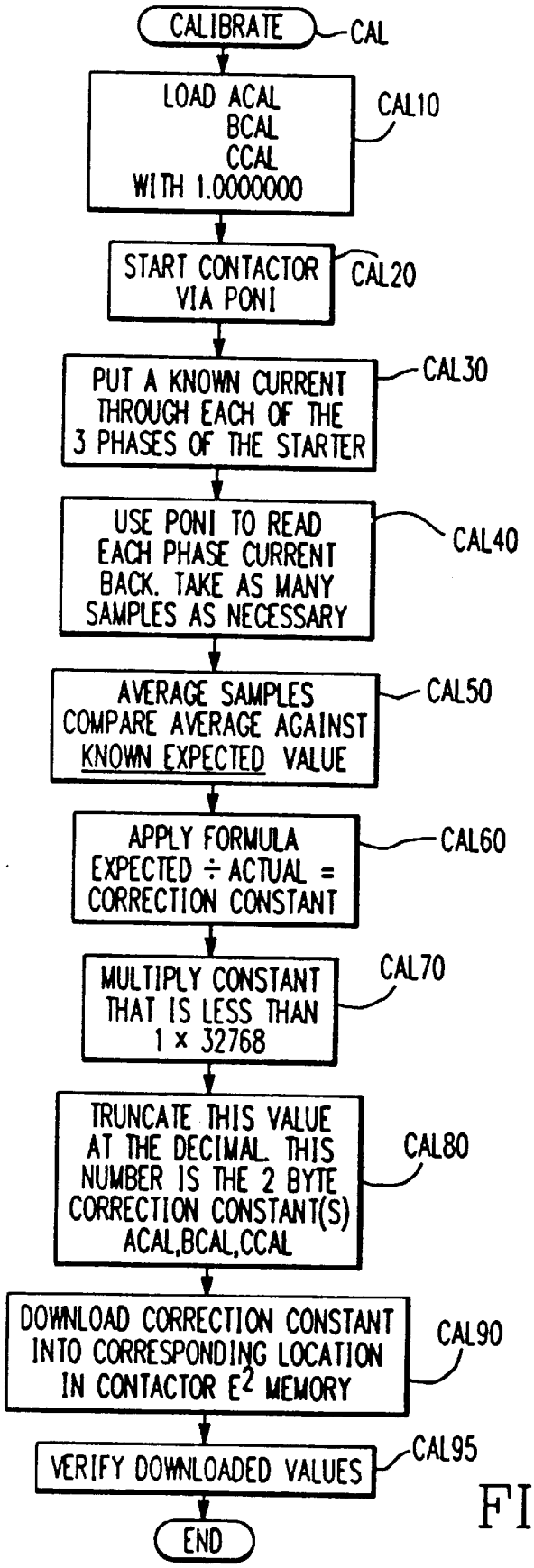
FIG. 15 shows a flow chart for calibrating the contactor.

Referring now to FIG. 14, the flow chart designated thermal (THER) is provided as part of the microprocessor control for the contactor of FIGS. 10. For purposes of simplicity of illustration, the phase correction and calibration will be described only with respect to one current which, in this embodiment of the invention, is arbitrarily chosen to be current IAIN. It is to be understood that correction and calculation with respect to gain correction factors for other circuit variables follow the same process. As indicated by block TH10, the first operation is to place the "pointer" of the microprocessor of the chip CU1 to a phase that has been uncorrected, which in this embodiment of the invention will be identified as the current contained in the 2-byte location IA0, IA1 for phase A. Each byte has eight bits of information stored therein. This information represents a derived electrical value. According to block TH20, these two bytes of data are then placed by the microprocessor portion of the chip CU1 into the TEMP0, TEMP1 random access memory locations. According to block TH30, the microprocessor then acquires corresponding correction constants such as ACAL from the calibration factor memory region or EEPROM and places those correction constants or factors into memory locations TEMP2 and TEMP3. It is understood that how the correction constants are derived has not yet been fully explained, but will be explained in detail with respect to FIG. 14. In the equation Y=MX+B for the lines of FIG. 12, M represents the slope or angle j for the various curves AGC, ACT, and COU. The offset OS as represented by the symbol B in the above equation is ignored in this embodiment of the invention. The correction constant adjusts the slope 14. According to block TH40, the information stored in bytes TEMP0, TEMP1 is multiplied by the information stored in the bytes TEMP2, TEMP3 to produce the results I2RESULT. This is done by a subroutine designated "MUL2". The product of the multiplication is stored in the random access memory in locations I2RESULT0, I2RESULT1, I2RESULT2, and I2RESULT3, as indicated by block TH40. The product is a 4-byte number. As is indicated in block TH50, it is necessary to correct for the decimal point by rotating to the left the bytes I2RESULT 0, 1, 2, 3 one time. This effectively places the decimal point in the correct place. In essence it means to move the decimal point one binary place to the left. And then, as indicated by block TH60, the I2RESULT 2, 3 bytes are placed back to where the phase current was found in the first place, which are locations IA0, IA1. This is equivalent of placing the most significant digits of the I2RESULT information into memory. The new information in the locations IA0, IA1 now represents corrected or derived out current or the current designated IAOUT in FIG. 12. The correction which has taken place has been one of slope correction rather than offset correction.

Referring now to FIG. 14 as well as FIGS. 10C, 11D, 12, the flow chart CALIBRATE for loading 2-byte gain correction information into locations ACAL, BCAL, and CCAL of the EEPROM of the chip CU1 is described. In this embodiment of the invention and for purposes of simplicity, only the calculation of the ACAL set of bytes is described. ACAL is a 2-byte, 8-bit per byte, word. In order to arrive at the word, the personal computer PC downloads by way of the apparatus of FIGS. 10, 11 into the contactor 10. The personal computer PC instructs the chip CU1 to place the binary number 1.000000 into the ACAL location. This is a starting point, and this is depicted in calibrate flow chart CAL. The loading is specifically depicted in block CAL10. The personal computer PC is then utilized, as indicated at block CAL20, to start the contactor 10 in such a manner that the contacts 22, 26, 44 and 46 thereof are closed, or at least it appears to the chip CU1 that the contacts are closed. At this point, as indicated at block CAL30, a known precise current or a first value of an input electrical variable is placed by way of the precision current source PCS through each of the three phases A, B, C of the contactor 10, as the case may be, so that the sensing devices CL1A, CL1B, CL1C, operate in the manner previously described to sense the input electrical variable (current) to thus place derived input current information in the random access memory in locations IA0, IA1, IB0, IB1, IC0, IC1, respectively. According to block CAL40, the stored phase or derived currents are then read back or communicated to the personal computer PC in the manner described previously. According to block CAL40, this may be done by a sampling technique in which phase currents are sensed, stored, and read back to the personal computer PC a multiple number of times, which, in a preferred embodiment of the invention, may be ten times, to provide an accumulated value of phase current in the personal computer, which is then divided by the number of entries, which in this case is ten, to provide an average value of phase current. This is done according to block CAL50. At this point it is important to recognize that the calibration factor is "1", so that the data that has been read back to personal computer PC is uncorrected data indicative of what the entire system represented by FIGS. 10C, 10D interpret the precision currents IA, IB, IC, to be. For instance, in a preferred embodiment of the invention, current IA, IB, IC may be 5-ampere root mean square (RMS) current, and yet when read back to the programmable controller PC one may appear to be 4.997 amperes, indicating an error of 0.003 ampere caused by error in the various elements shown in FIGS. 10C, 10D. It is interesting to note at this point that the actual current, though being 5 amps, is derived by the system or interpreted thereby as being only 4.997 amps by the apparatus of FIGS. 10C, 10D. It is also important to recognize, and it is an important part of the present invention, that regardless of the value sensed by the personal computer, i.e., 4.997 amperes, the actual value being measured is 5 amperes, and therefore the interpreted or derived value of 4.997 amperes really represent 5 amperes. The personal computer PC then takes these average samples and compares them against the known expected value, which is 5 amperes. The personal computer PC then calculates the calibration factor according to the relationship: the calibration factor equals the first value of input electrical current divided by the first derived value. For example, in the personal computer PC the expected or first value of 5 amperes is divided by the actual or derived value of 4.997 to produce a correction constant 1.006; this is done according to block CAL60. Blocks CAL70, CAL80 digitally manipulate the data to place it in a proper form for being resubmitted or communicated to the calibration factor memory of the chip CU1 for digital placement therein. Block CAL90 indicates that the correction constant should be downloaded into the corresponding locations in the contactor EEPROM memory. This is a memory which is nonvolatile, and once values are stored or "locked" therein they cannot be easily removed. Consequently, once the device in question has been calibrated at the factory and the proper calibration values have been loaded into the EEPROM memory, the customer/user cannot inadvertently erase the valuable calibration data. This information is stored in the ACAL, BCAL, CCAL locations in the EEPROM memory. As is shown in block CAL95, the personal computer PC interrogates the EEPROM to verify that the values which were downloaded are correct. At this point the calibration procedure has been completed. It will be noted by referring again to FIG. 14, block TH30, that when the chip CU1 is instructed to acquire the corresponding correction constants and place them in RAM locations TEMP2,3, for example, it is the corrected calibration values ACAL, BCAL and CCAL which are placed into the TEMP2,3 locations. Consequently, when device 10 performs its useful function, the appropriate derived value will be effected by the calibration factor.

Referring once again to FIGS. 10, 11, the path of communication between the personal computer PC and the memories of the chip CU1 is described. In particular, information travels from the personal computer PC to the memories of the sure chip CU1 in the following manner: Information travels down the twisted pair TP to the connector MP2 in the form of zeroes and ones represented by modulated high frequency AC signals from whence the information is provided by way of the transformer MT1 to the demodulator represented by the circuitry associated with the comparator MU1A, to then be provided as a series of digital ones and zeroes at the output terminal MRX. The output terminal MRX is interconnected with the basic INCOM chip MU4 from whence it is supplied by way of the serial data channel SERDAT to terminal PA2 of the microprocessor MU3, and from thence to the data OUT line DO to the connector MJ2 at terminal 5. There the data goes to the connector CJ2 at terminal 4 and the DI line. From thence the data moves to the SDI terminal of the chip CU1 where it may be routed to an EEPROM location therein.

Data such as ACAL resident in the EEPROM of the chip CU1 may be transferred out by way of the SDO terminal of the surechip CU1 and the DO output line to the connector CJ2 at terminal 5. From there the data is routed to the connector MJ2 at terminal 6 and to the DI input line and thence to the MISO input terminal of the microprocessor MU3. From there it is provided from terminal PA2 to the SERDAT terminal of the INCOM chip MU4, and from there to the TX output terminal as signal MTX. The TX output terminal feeds the modulator circuit represented, for example, by the comparator MU1B and the field effect transistor MQ1, as shown in FIG. 11D. From there the data is fed by way of the resistor MR14 to the secondary winding MS1 of the transformer MT1, and then back through connector MP2 and the twisted pair TP and to the personal computer.

Amplitude Calibration Method 1

This procedure utilizes the product microprocessor MU3 to calculate the gain correction factor based on a digital message received from the external computer PC that the test currents are at the desired calibration values. In this case the external computer PC could even be replaced by a jumper to other parts of the chip CU1 or the microprocessor MU3 which will cause the product to execute the calibration code, calculate the gain constants, and store the values in nonvolatile memory.

This technique has the advantage that it is simple, reliable and does not require an external computer.

Amplitude Calibration Method 2

In this procedure the gain factor calculation is done by the external computer PC as described previously. The product through the communications channel passes to the external computer PC both the value of currents and the associated gain factors which the product used to calculate the current values. The external computer PC compares the current values received from the product to those received from the current transducers. New gain factors are then calculated and sent to the chip CU1 for storage in nonvolatile memory as shown below:

GAIN FACTOR new=GAIN FACTOR old * (CURRENT from the reference/CURRENT from the product)

Time Calibration Method 1

The oscillator frequency can be measured directly by means of a frequency meter. The external computer PC can calculate the timer compare register load value increment by LOAD VALUE new=LOAD VALUE ideal * (OSC.FREQ. actual/OSC.FREQ. ideal)

This value can be sent to product for storage in nonvolatile memory.

Time Calibration Method 2

A more automatic method for time calibration uses circuitry associated with the external computer PC to measure the frequency of the serial clock or some other product microprocessor output which is related to the product's execution time and then automatically sends a request to the product to either increase or decrease compare the register load increment.

Referring now to Table I, the pin reconciliation for the input pins of the INCOM chip MU4 of the present specification and the INCOM chip of the incorporated-by-reference U.S. Pat. No. 4,644,547 is set forth.

TABLE I

PIN RECONCILIATION

| Pin Numbers This INCOM Chip (MU4) | Pin Numbers INCOM Chip of U.S. Patent 4,644,547 |
|---|---|
| 1 | 28 |
| 4 | 4 |
| 5 | 3 |
| 6 | 5 |
| 7 | 6 |
| 9 | 8 |
| 10 | 9 |
| 11 | 10 |
| 12 | 11 |
| 13 | 12 |
| 14 | 13 |
| 15 | 14 |
| 16 | 15 |
| 17 | 16 |
| 18 | 17 |
| 19 | 18 |
| 20 | 19 |
| 21 | 20 |
| 22 | 21 |
| 23 | 22 |
| 24 | 23 |
| 25 | 24 |
| 26 | 25 |
| 27 | 26 |

Ultrasonic Coil Current Regulator

Figure 6:
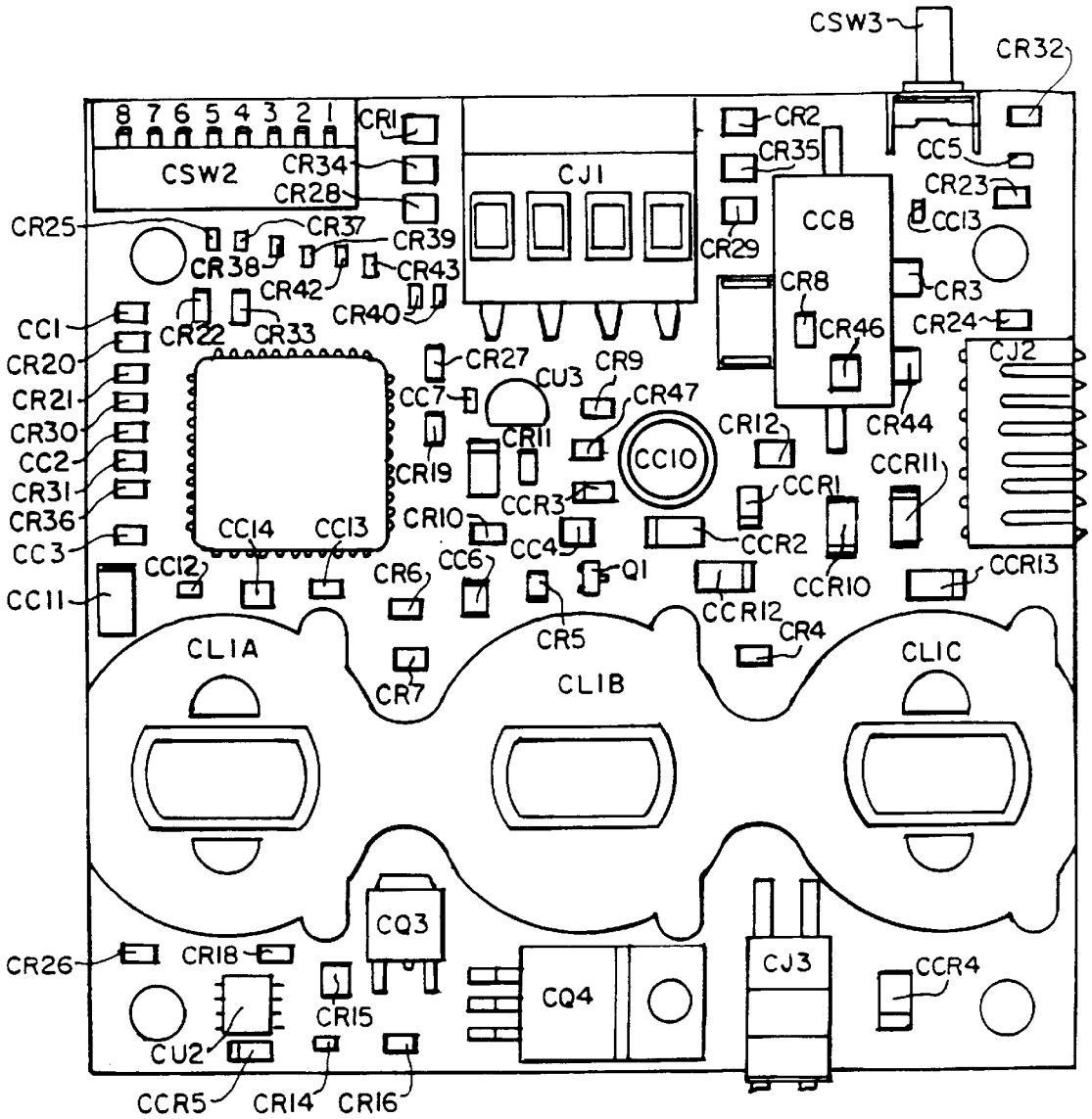
FIG. 6 shows a top view of the component layout of the microprocessor controlled circuit board assembly utilized in the apparatus of the preceding figures.

An important aspect of the invention relates to an ultrasonic coil current regulator. As previously mentioned, phase angle current regulator circuits, for example, as disclosed in U.S. Pat. No. 4,893,102 can cause audible noise in the electromagnet assembly. This noise is generated as a result of the relatively high rate of change of flux developed within the solenoid coil SC in response to the abrupt changes in the electrical current pulses, for example, as shown in FIG. 6 of the aforementioned patent applied to the solenoid coil SC during this condition. An important aspect of the invention relates to the fact that a regulated source of electrical current is applied to the solenoid coil during both the closing and hold in condition. The regulated source of electrical current eliminates abrupt changes in the magnitude of electrical currents applied to the solenoid coil SC which, in turn, reduces the rate of change of flux therethrough which eliminates audible noise from the electromagnet assembly. Moreover, by supplying a regulated source of electrical current to the solenoid coil, the RMS value of the electrical current applied during the hold in condition will be relatively less than the RMS current value in a phase angle regulated circuit as described in the aforementioned U.S. patent. More specifically, in a phase angle regulated circuit, the force required to open the contacts is determined by the lowest decay point of the electric current supplied to the solenoid coil SC between updates. Since the updates in that circuit are so far apart, it is necessary to supply a relatively higher RMS electrical current to prevent the biasing springs from causing the main contacts to open. This relatively higher RMS current provides additional heating of the solenoid coil SC. This problem is solved by the present invention by providing a regulated source of electrical current to the solenoid coil SC during a hold in condition.

Figure 10G:
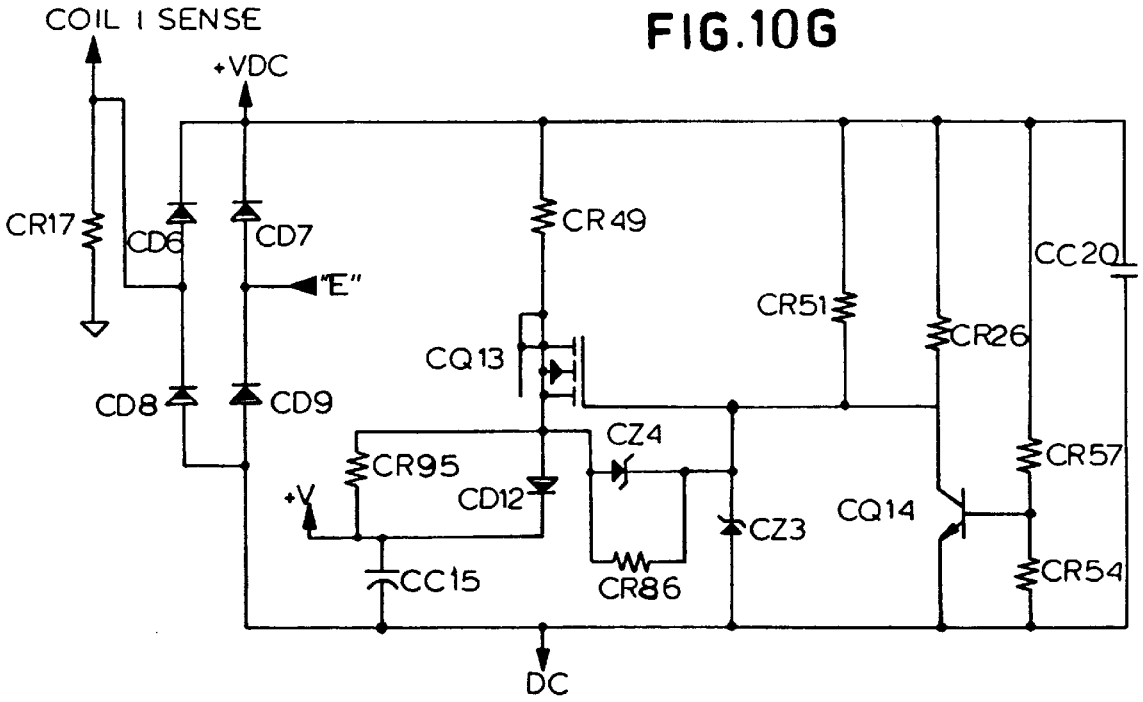
FIGS. 10E–10G are schematic diagrams of the ultrasonic coil current regulator in accordance with the present invention.
Figure 10H:
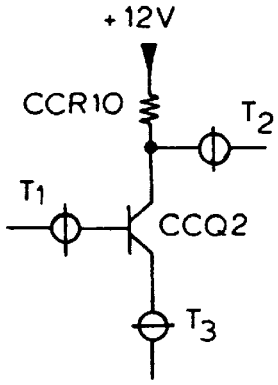
FIG. 10H is a partial schematic diagram of an alternate embodiment of the ultrasonic coil current regulator illustrated in FIGS. 10E–10F.
Figure 10D:
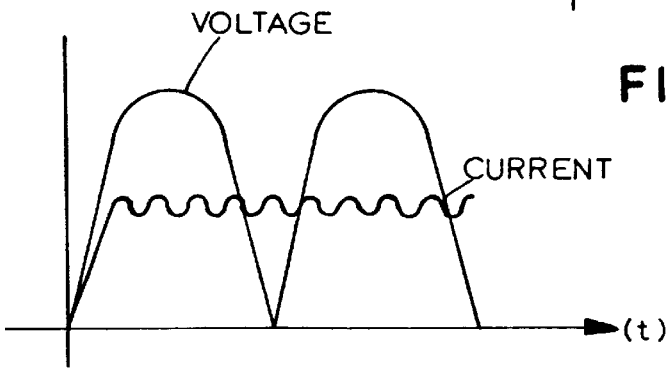
FIG. 10D is a graph of the voltage and current waveforms developed by the ultrasonic coil current regulator illustrating the current waveform greatly exaggerated in accordance with an alternate embodiment of the present invention.

The circuit in accordance with the present invention provides an electrical current profile to the solenoid coil SC as shown greatly exaggerated in FIG. 10D. Since the circuit prevents the electrical current from decaying to a relatively low value, such as in the aforementioned U.S. patent, the circuitry is able to automatically compensate for magnetic coupling from the main poles which otherwise could cause the contactor to open. Consequently, a relatively high hold in force is also provided which allows relatively lower input voltages than previously possible. Moreover, the circuitry provides relatively fast on to off time, which allows the off time to be fairly large while also minimizing amplitude changes in the output current which minimizes energy consumption of the coil which, in turn, reduces undesirable coil heating.

With reference to FIGS. 10E–10H, the circuitry in accordance with the present invention includes a pair of power switches generally identified with the reference numerals UCR-1 and UCR-2, for connecting the solenoid coil SC to a source of electrical power. The power switches UCR-1 and UCR-2 are under the control of a power drive circuit UCR-5, a trigger circuit, identified with the reference numeral UCR-3 and a timing circuit, identified with the reference numeral UCR-4. As will be described in more detail below, on power-up, the power drive circuit UCR-5 is under the control of the timing circuit UCR-4. More specifically, during power-up, the timing circuit UCR-4 controls the power drive circuit UCR-5 such that the power switches UCR-1 and UCR-2 close to connect the solenoid coil SC to a source of electrical power, for example, a full wave rectified unfiltered source of electrical power. Once the power switches UCR-1 and UCR-2 close, the electrical current in the solenoid coil SC is monitored. When the electrical current reaches a predetermined level, the trigger circuit UCR-3 triggers the timing circuit UCR-4 to disable the power drive circuit UCR-5 for a predetermined time period causing the power switches UCR-1 and UCR-2 to open, thus disconnecting the solenoid coil SC relatively quickly from the source of electrical power for such time period. During the predetermined time period, the electrical current in the solenoid coil SC is allowed to decay. The relatively quick disconnection of the solenoid coil SC from the source of electrical power allows the energy applied to the solenoid coil to be reduced, which, in turn, reduces undesirable heating in the solenoid coil SC. After the predetermined time period times out, the timing circuit UCR-4 triggers the power drive circuit UCR-5 to cause the power switches UCR-1 and UCR-2 to close, which, in turn, connects the solenoid coil SC to the source of electrical power. The cycle is then repeated.

Two embodiments of the invention are disclosed. In a first embodiment of the invention, the trigger circuit UCR-3 includes a feedback circuit illustrated in FIG. 10F for comparing the electrical current in the solenoid coil SC with a reference value. More specifically, in both embodiments, a current sensing resistor is provided to convert the electrical current flowing in the solenoid coil SC to a representative voltage. This representative voltage is then compared with a reference voltage by way of a comparator to provide a trigger signal to the timing circuit UCR-4 when the representative voltage equals or exceeds the reference voltage. In the second embodiment of the invention, illustrated in FIG. 10H, the feedback circuit is substituted with a bipolar transistor. In this embodiment, the representative voltage is applied across a base-emitter junction of a bipolar transistor.

Figure 10E:
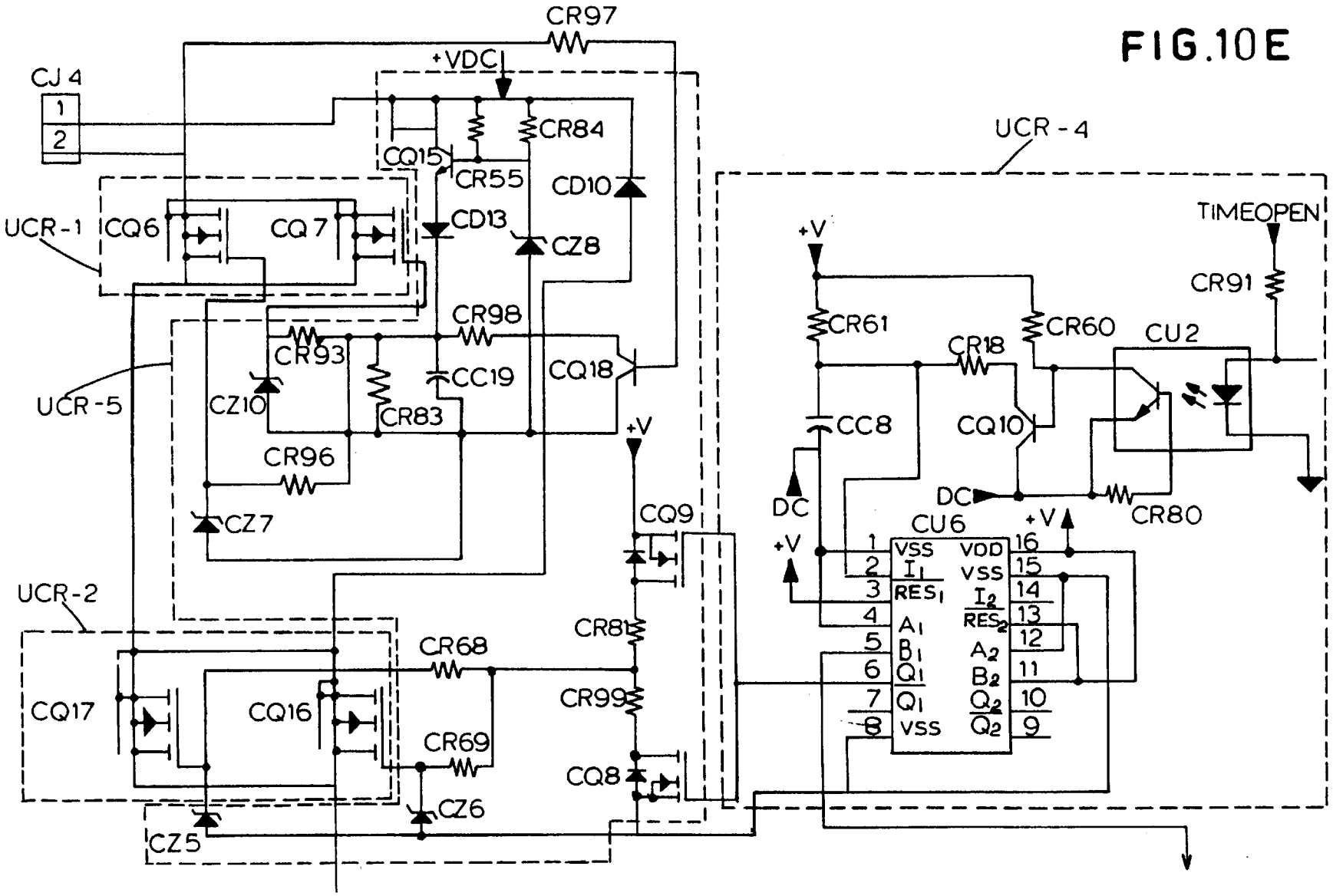
Figure 10F:
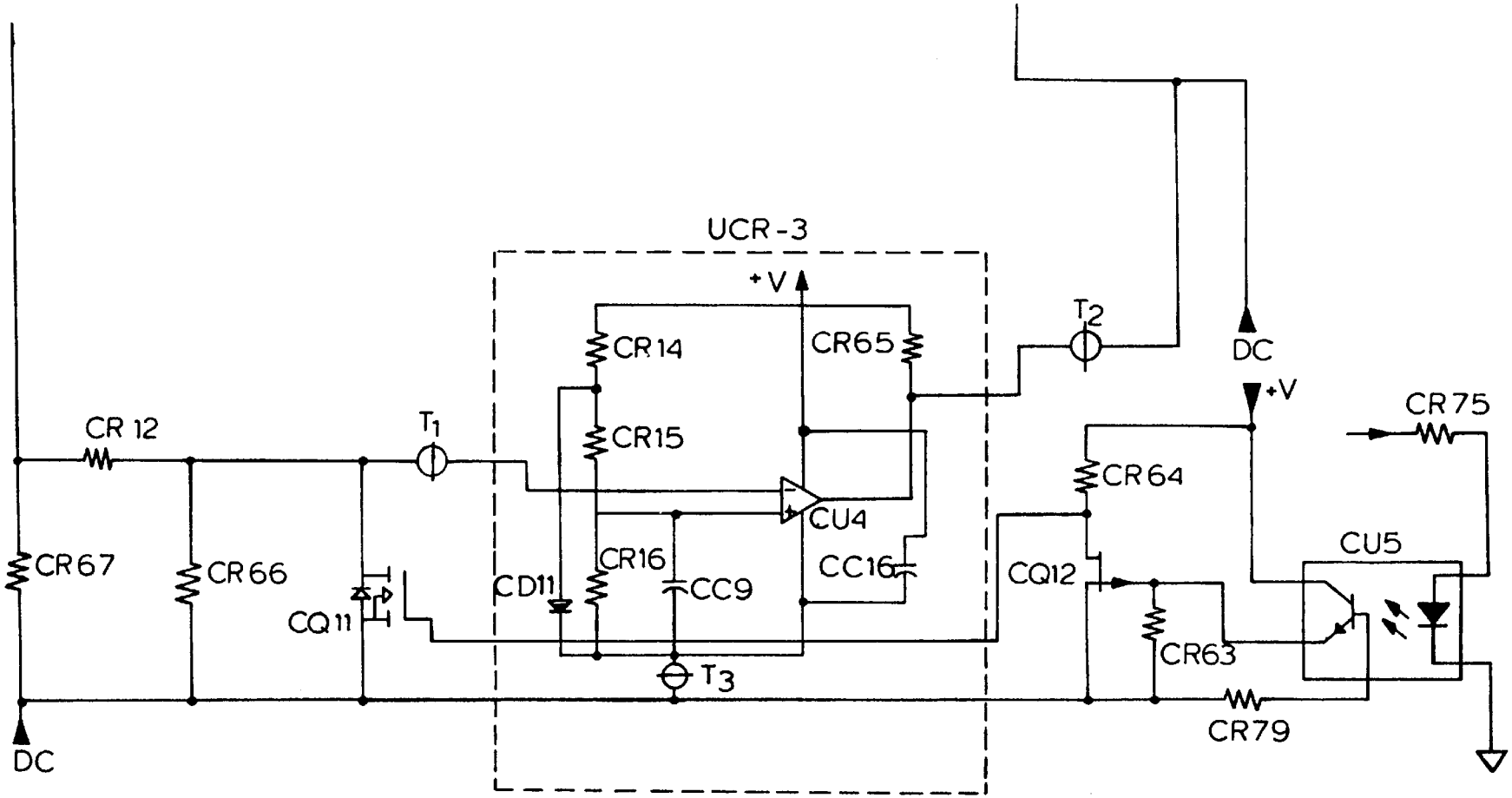

In both embodiments of the invention, the power switch and drive circuitry illustrated in FIG. 10*b,* which includes the resistors CR14 through CR18, CR26, the optocoupler CU2, the transistor CQ3 and CQ4 as well as the diode CCR4, is substituted with the circuitry illustrated in FIGS. 10E, 10F and 10G. The balance of the circuitry heretofore described illustrated in FIGS. 10A, 10B, 10C, 11A, 11B and 11C is essentially the same as heretofore described. In these embodiments, the solenoid coil SC is connected to terminals 1 and 2 of a terminal block CJ4 (FIG. 10E). As previously discussed, a source of AC control power, for example 120 volts AC, is applied to terminals 3 and 4 of the terminal block CJ1 (FIG. 10A). The control power is, in turn, applied to a full wave rectifier which includes diodes CD6, CD7, CD8 and CD9. The full wave rectifier defines a positive DC terminal identified as "E" and a negative DC terminal which is applied to the SURE CHIP integrated circuit CU1 (described in U.S. Pat. No. 5,325,315) in a manner as discussed above. The negative DC terminal is also connected to ground by way of a resistor CR17 as discussed above. The full wave rectifier provides full wave unfiltered voltage to the solenoid coil SC. More specifically, the full wave rectifier defines a pair of terminals identified in FIG. 10G as "+VDC" and "DC". As shown in FIG. 10E, the +VDC terminal is applied to terminal 1 of the terminal block CJ4 while the DC terminal is connected to the current sensing circuitry (FIG. 10F).

The balance of the circuitry illustrated in FIG. 10G relates to a regulated power supply for generating a DC voltage identified as +V. This circuitry includes transistors CQ13, CQ14, Zener diodes CZ3 and CZ4, a diode CD12, capacitors CC15 and CC20 and resistors CR26, CR49, CR51, CR54, CR57, CR86 and CR95. In operation, the unfiltered, rectified voltage +VDC is applied across the resistors CR54 and CR57 which, in turn, causes the transistor CQ14 to turn on. The capacitor CC20 disposed in parallel with the resistors CR54 and CR57, prevents any rapid changes in +VDC. Once the transistor CQ14 is turned on, this causes the collector to go low due to the voltage drop across the resistors CR26 and CR51, which, in turn, gates the transistor CQ13. Once the transistor CQ13 turns on, electrical current through the resistor CR95 generates the voltage +V. The diode CD12, disposed in parallel with the resistor CR95, provides voltage clipping. The Zener diodes CZ3 and CZ4 as well as the resistor CR86 is for protection of the transistors CQ13 and CQ14.

Referring to FIG. 10E and 10F, the first embodiment of the ultrasonic coil current regulator in accordance with the present invention is illustrated. The control circuit in accordance with the present invention includes the power switch, disposed within the dashed box identified as UCR-1, which includes the field effect transistors CQ6 and CQ7, arranged such that their respective drain and source terminals are connected in parallel. One end of the parallel connected transistors CQ6 and CQ7 is connected to one end of the solenoid coil SC by way of the terminal block CJ4. The other end of the transistors CQ6 and CQ7 is attached to another power switch, disposed within the dashed box identified as UCR-2, which includes a pair of parallel coupled transistors CQ16 and CQ17. The power switch UCR-2, in turn, is connected to a flyback diode CD10 which, in turn, is connected to the other side of the solenoid coil SC by way of the terminal block CJ4.

The power switches UCR-1 and UCR-2 are utilized to connect the solenoid coil SC to the current regulator circuit in order to regulate the electrical current that flows therethrough. More specifically, a current sensing resistor CR67 is serially connected to the solenoid coil SC by way of the power switches UCR-1 and UCR-2. Thus, any electrical current that flows through the solenoid coil SC is sensed by the current sensing resistor CR67 to develop a voltage proportional to the magnitude of electrical current flow through the solenoid coil SC. This voltage is applied to a trigger circuit, illustrated within the dashed box identified as UCR-3, by way of a voltage divider circuit which includes a plurality resistors CR12 and CR66. In the first embodiment, the trigger circuit UCR-3 includes a plurality of transistors CQ11 and CQ12, a plurality of resistors CR14, CR15, CR16, CR63, CR64, CR65, CR75 and CR79, a plurality of capacitors CC9, CC16 and CC17, a diode CD11, an optocoupler CU5 and an operational amplifier CU4. The trigger circuit UCR-3 is used to control a timing circuit illustrated within the dashed box identified as UCR-4. The timing circuit UCR-4 includes a monostable multivibrator CU6, an optocoupler CU2, a plurality of resistors CR18, CR60, CR61, CR80 and CR91, a capacitor CC8 and a transistor CQ10. The timing circuit UCR-4 is used to control the power drive circuit shown within the dashed box UCR-5 for controlling the switching of the power switches UCR-1 and UCR-2. The power drive circuit UCR-5 includes a plurality of transistors CQ8, CQ9, CQ15 and CQ17, a plurality of resistors CR55, CR68, CR69, CR70, CR81, CR83, CR84, CR93, CR96, CR98 and CR99, a capacitor CC19, a plurality of Zener diode Z5, Z6, Z7, Z8 and Z10 and a diode D13. The power drive circuit UCR-5 functions to control the switching of the power switches UCR-1 and UCR-2 in response to the timing circuit UCR-4 as well as the trigger circuit UCR-3 in order to regulate the electrical current flowing through the solenoid coil SC as described below.

Two control signals from the SURE CHIP integrated circuit CU1 (described in U.S. Pat. No. 5,325,315) control the operation of the ultrasonic coil regulator circuit in accordance with the present invention. These control signals are identified as "TIMEOPEN" and "FETDRIVE", available at terminals PC2 and PC5 of the SURE CHIP integrated circuit CU1 (FIG. 10A), respectively. These signals FETDRIVE and TIMEOPEN do not form a part of the present invention and are described hereinbelow to the extent necessary to understand the present invention. In general, the FETDRIVE signal is a series of pulses, generated to control the velocity of closing of the contactor in a manner similar as described in detail in U.S. Pat. No. 4,893,102, assigned to the same assignee as the present invention and hereby incorporated by reference. The TIMEOPEN signal is used to control the current regulator. Both the FETDRIVE and TIMEOPEN signals, are utilized in conjunction with the trigger circuit UCR-3 to control the closing of the contactor. More specifically, once a start request has been received, for example, a contact closure is sensed between the terminals 1 and 4 of the terminal block CJ1 (FIG. 10A) and a permissive signal "P" is available as described above, both the TIMEOPEN signal as well as the FETDRIVE signal go high. The FETDRIVE signal is applied to the optocoupler CU5, which forms a part of the trigger circuit, UCR-3 by way of the resistor CR75. This, in turn, activates an output transistor within the optocoupler CU5 in order to apply a voltage to the gate of the transistor CQ12. More specifically, once the input of the optocoupler CU5 is activated, the output transistor is biased on by the resistors CR63 and CR73. This causes the transistor CQ12, whose gate is connected to the output transistor, to transition from a low impedance state to a high impedance state. This allows the transistor CQ12 to form a voltage divider with the resistor CR64 in order to provide a sufficient gate voltage to the transistor CQ11.

The transistor CQ11 controls the current regulation of the circuit. More specifically, when the transistor CQ11 is on, the voltage applied to the negative terminal of the operational amplifier CU4 will be held below the reference value to disable the timing circuit UCR-4. This allows for the normal closing current to flow through the solenoid coil SC. The normal closing current is relatively larger, for example, ten times, then the value of the regulated current applied to the solenoid coil SC during a hold in operation in order to maintain the separable main contacts in a closed position. Once the closing profiles are complete, the FETDRIVE signal goes low. As will be discussed in more detail below, the contactor will remain in a closed position until the TIMEOPEN signal goes low.

The TIMEOPEN signal is applied to the optocoupler CU2, which forms a part of the timing circuit UCR-4, by way of the resistor CR91. The resistor CR91 is used to limit the electrical current to the light emitting diode forming the input to the optocoupler CU2. This, in turn, activates an output transistor in the optocoupler CU2. A resistor CR80 is connected between the base and emitter terminals of the output transistor in the optocoupler CU2 for biasing. The collector terminal of the output transistor within the optocoupler CU2 is connected to a base terminal of the transistor CQ10. The transistor CQ10, connected to the output transistor of the optocoupler CU2, is normally on (e.g., when the TIMEOPEN signal is low) by way of the resistor CR60 connected between the base thereof and the voltage +V generated by the power supply discussed above. However, since the collector terminal of the output transistor in the optocoupler CU2 is serially connected to the base terminal of the transistor CQ10, once the output transistor of the optocoupler CU2 is turned on, this action clamps off the transistor CQ10. Since the collector and emitter terminals of the transistor CQ10 are connected in parallel with the capacitor CC8 by way of the resistor CR18, once the transistor CQ10 is turned off, the capacitor CC8 is charged by way of the serially coupled resistor CR61. Once the voltage across the capacitor CC8 exceeds a predetermined value, for example, two-thirds the value of +V, the output of the monostable multivibrator CU6, which may be, for example, a Motorola MC14528B, transitions. More specifically, one end of the capacitor CC8 is applied to a trigger terminal Al within the monostable multivibrator CU6. Once the capacitor CC8 charges to a predetermined voltage level, the Q1 output of the monostable multivibrator CU6 will go high. This causes the transistor CQ9 to turn on. When CQ9 turns on, a voltage is applied to the gates of the power switch transistors CQ16 and CQ17. This voltage causes the transistors CQ16 and CQ17 to turn on. As will be discussed in detail below, this also causes the power switch transistors CQ6 and CQ7 to turn on, which, in turn, allows electrical current to flow through the solenoid coil SC.

This electrical current also flows through the current sensing resistor CR67 where it is converted to a voltage. The voltage developed across the resistor CR67 is applied to an inverting input of the operational amplifier CU4 by way of a voltage divider which includes the resistors CR12 and CR66. This voltage, which represents the electrical current flow through the solenoid coil SC, is compared with a reference voltage, derived from the voltage V+ by way of the resistors CR14, CR15 and CR16. The reference voltage is applied to the non-inverting input of the operational amplifier CU4. Once the electrical current flowing through the solenoid coil SC builds up to a value which causes a voltage across the resistor CR67 to be greater than the reference voltage at the operational amplifier CU4, the operational amplifier CU4 transitions and resets the monostable multivibrator CU6. The output of the comparator CU4 is applied to the trigger input B1 of the monostable multivibrator CU6 which causes the power switches UCR-1 and UCR-2 to disconnect the solenoid coil SC from the circuit for a predetermined time period as will be discussed below.

The electrical current through the solenoid coil SC also passes through the resistor CR17 (FIG. 10G). The resistor CR17 is used to convert the electrical current to a voltage which can be read by the SURE CHIP integrated circuit CU1 for selecting the proper closing profile.

Once the contactor is closed, the FETDRIVE signal goes low and the separable main contacts will remain closed until the TIMEOPEN signal goes low. During this condition a hold in current is applied to the solenoid coil SC to prevent the contactor from opening under the influence of the biasing springs.

The regulation of the electrical current through the solenoid coil SC after the contactor is closed (e.g., hold in current) is controlled by the timing circuit UCR-5. More specifically, as the voltage across the capacitor CC8 exceeds a predetermined value, for example, two-thirds of the magnitude of the voltage +V, the output of the monostable multivibrator CU6 goes low. This, in turn, turns on the P channel transistor CQ9. The P channel transistor CQ9, in turn, turns on the power switching transistors CQ16 and CQ17 which, as will be described below turns on the transistors CQ6 and CQ7. This allows electrical current to flow through the solenoid coil SC and be sensed by the current sensing resistor CR67. The voltage developed across the sensing resistor CR67 is applied to the comparator CU4 by way of the voltage divider formed from the resistors CR12 and CR66. When the electrical current through the solenoid coil SC exceeds a predetermined value, the voltage applied to the comparator CU4 will exceed the reference voltage and cause the comparator CU4 to go low. As previously mentioned, since the output of the comparator CU4 is connected to the trigger input B1 of the monostable multivibrator CU6, this low causes the output of the monostable multivibrator CU6 to transition from high to low. This, in turn, allows the capacitor CC8 to be discharged to approximately one-third of V+ which, in turn, causes the Q1 output of the monostable multivibrator CU6 to go high. This, in turn, causes the transistor Q9 to turn off and the transistor Q8 to turn on. Once this occurs, this causes the transistors Q16 and Q17 as well as the transistors CQ6 and CQ7 to turn off. During this off time, the capacitor CC8 charges to a predetermined value, for example, two-thirds +V. Once the voltage across the capacitor CC8 reaches this value, the Q1 output of the monostable multivibrator CU6 will go high and the cycle will be repeated. The circuitry thus allows the transistors CQ16 and CQ17 to be cycled at a naturally varying frequency.

As discussed above, the state of the transistors CQ6 and CQ7 is controlled by the state of the transistors CQ16 and CQ17. More specifically, whenever the switching transistors CQ16 and CQ17 turn on, the parallel connected resistors CR55 and CR84 pass electrical current through the Zener diode CZ8. The voltage reference, formed at the Zener diode CZ8, forms an emitter follower with the transistor CQ15. The output of the transistor CQ15 is connected to a diode CD13 which, in turn, is used to charge a serially coupled capacitor CC19. The voltage across the capacitor CC19 is applied to the gate of the transistors CQ6 and CQ7. Thus, whenever the power transistors CQ17 and CQ16 turn on, the transistors CQ7 and CQ6 will also be on. Whenever the transistor CQ17 turns off, the capacitor C19 discharges through the resistor C83. This decay is usually short in duration because the transistor CQ17 turns on, for example, every 100 microseconds.

As previously mentioned, the circuit will maintain a sufficient regulated holding current relative to the solenoid coil SC until the TIMEOPEN signal is removed (e.g., goes low). More specifically, when the TIMEOPEN signal goes low, the transistors CQ17 and CQ16 turn off, thereby opening the electrical current path to the solenoid coil SC. After the transistors Q16 and Q17 are turned off, the voltage across the capacitor C19 begins to decay. The values of the capacitor CC19 as well as the discharge resistor CR83 are selected such that the FET gate threshold is not reached until a predetermined value, for example, approximately three-quarters of the holding energy remains in the solenoid coil SC.

As the transistors CQ6 and CQ7 begin to turn off, a voltage builds thereacross which is applied to the base of the transistor CQ18 by way of the resistor R97. When the transistor CQ18 turns on, the decay rate is increased since the resistor CR98 is now in parallel with the resistor CR83. This forces the transistors CQ6 and CQ7 to turn off which, in turn, separates the solenoid coil SC from the flyback diode CD10. The resistor CR83 holds the transistors CQ6 and CQ7 off until the next time the transistors CQ16 and CQ17 are permitted to turn on.

In an alternate embodiment of the invention the trigger circuit UCR-3, connected between the terminals identified as T1, T2 and T3 (FIG. 10F), is substituted with the circuit illustrated in FIG. 10*g* which includes a transistor CCQ2 and a resistor CCR10. More specifically, the emitter terminal of the transistor CCQ2 is connected to terminal T3 while the base terminal is connected to terminal T1. The collector terminal is connected to terminal T2. The power supply voltage +V is connected to the collector by way of the resistor CCR10.

In this embodiment, the collector voltage of the transistor CCQ2 is used to trigger the monostable multivibrator CU6 instead of the feedback circuit. More specifically, as previously described, the FETDRIVE and TIMEOPEN signals are used to control switching of the transistors CQ6, CQ7, CQ16 and CQ17 in a manner as discussed above. Once these transistors CQ6, CQ7, CQ16 and CQ17 are turned on, electrical current flows through the solenoid coil SC which is sensed by the current sensing resistor CR67. The voltage across the current sensing resistor CR67 is applied to the base of the transistor CC12 by way of the voltage divider formed from the resistors CR12 and CR66. When the transistor CCQ2 turns on, the voltage at the collector terminal drops. The collector terminal of the transistor CCQ2 is connected to the trigger input B1 of the monostable multivibrator CU6 to cause the Q output to go high. This action causes the transistors CQ6, CQ7, CQ16 and CQ17 to turn off for a fixed period of time as determined by the resistor CR61 and the capacitor CC8 as discussed above. Once the fixed time period times out, the Q output of the monostable multivibrator CU6 goes low to turn on the transistors CQ6, CQ7, CQ16 and CQ17 in a manner as described above and the cycle is repeated.

Column 4, line 39 through column 6, line 45; column 26, line 53 through column 90, line 25; and FIGS. 16–18, 19A–19D, 20–32, 33A–33D and 34–68 of U.S. Pat. No. 5,325,315 are incorporated by reference herein.

Many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. An electrical device for connecting a source of electrical power to an electrical load comprising:

one or more pairs of separable main contacts;

an electromagnet including an armature mechanically interlocked with said one or more pairs of separable main contacts, said armature movably mounted to allow said one or more pairs of separable main contacts to be placed in a CLOSED position or alternatively in an OPEN position, said electromagnet also including a solenoid coil for controlling the movement of said armature;

means for connecting said solenoid coil to a source of electrical power in order to apply electrical current to said solenoid coil;

means for sensing the electrical current applied to said solenoid coil;

means for modulating the sensed electrical current of said sensing means;

means for comparing the modulated sensed electrical current of said modulating means with a predetermined value; and regulating means cooperating with said comparing means for regulating the electrical current applied to said solenoid coil, said modulating means modulating the sensed electrical current of said sensing means in order to place said separable main contacts in the CLOSED position from the OPEN position, said regulating means for regulating the electrical current applied to said solenoid coil in order to maintain said separable main contacts in the CLOSED position.

2. The electrical device as recited in claim 1, wherein said sensing means includes resistor means serially coupled to said solenoid coil; and wherein said modulating means includes dividing means and switching means, the dividing means parallel coupled to the resistor means and having a tap, the switching means connected to the center tap of the dividing means.

3. The electrical device as recited in claim 2, wherein the resistor means includes a first resistor serially coupled to said solenoid coil, the first resistor having two nodes; and wherein the dividing means includes a second resistor connected between a first node of the first resistor and the tap of the dividing means, and a third resistor connected between the tap of the dividing means and a second node of the first resistor.

4. The electrical device as recited in claim 1, wherein the source of electrical power is an alternating current power source; wherein said connecting means includes full wave rectifier means for rectifying the alternating current power source; wherein the electrical current applied to said solenoid coil is a full wave rectified electrical current; and wherein the sensed electrical current of said sensing means is derived from said full wave rectified electrical current.

5. The electrical device as recited in claim 1, wherein said regulating means includes means responsive to said comparing means for disabling said regulating means for a predetermined time period when said electrical current applied to said solenoid coil reaches a predetermined value; and wherein said comparing means includes means for providing a trigger signal directly to the disabling means.

6. The electrical device as recited in claim 5, wherein the trigger signal providing means provides the trigger signal when said electrical current applied to said solenoid coil reaches a predetermined value.

7. The electrical device as recited in claim 5, wherein the disabling means includes means for providing a timing signal responsive to the trigger signal; and wherein said timing signal providing means includes a monostable multivibrator, directly responsive to said comparing means.

8. An electrical device as recited in claim 1, wherein said comparing means includes an operational amplifier.

9. The electrical device as recited in claim 1, wherein said regulating means includes means responsive to said comparing means for disabling said regulating means for a predetermined time period when said electrical current applied to said solenoid coil reaches a predetermined value; and wherein said comparing means includes a transistor and means for biasing said transistor as a function of said electrical current applied to said solenoid coil, the transistor providing a trigger signal directly to the disabling means.

10. An electrical device for connecting a source of electrical power to an electrical load comprising:

separable contact means;

electromagnet means including an armature mechanically interlocked with said separable contact means, said armature movably mounted to allow said separable contact means to be placed in a CLOSED position or alternatively in an OPEN position, said electromagnet means also including a solenoid coil for controlling the movement of said armature;

means for connecting said solenoid coil to a source of electrical power in order to apply electrical current to said solenoid coil;

means for sensing the electrical current applied to said solenoid coil;

modulating means for modulating the sensed electrical current of said sensing means, said modulating means having a first state associated with the OPEN position of said separable contact means, a second state associated with placing said separable contact means in the CLOSED position from the OPEN position, and a third state associated with the CLOSED position of said separable contact means;

trigger signal providing means cooperating with said modulating means for providing a trigger signal when the modulated sensed electrical current of said modulating means reaches a predetermined value; and regulating means cooperating with said trigger signal providing means for regulating the electrical current applied to said solenoid coil in order to maintain said separable contact means in the CLOSED position.

11. The electrical device as recited in claim 10, wherein said modulating means includes a transistor having a first static state, a second static state associated with the CLOSED position of said separable contact means, and a dynamic state associated with placing said separable contact means in the CLOSED position from the OPEN position, the dynamic state including a series of transitions between the first and second static states.

12. The electrical device as recited in claim 11, wherein said sensing means includes resistor means serially coupled to said solenoid coil; and wherein said modulating means further includes dividing means parallel coupled to the resistor means and having a tap, the transistor connected to the tap of the dividing means.

13. The electrical device as recited in claim 11, wherein the transistor is turned on during the first static state thereof and is turned off during the second static state thereof.

14. The electrical device as recited in claim 10, wherein said regulating means includes means responsive to said trigger signal providing means for disabling said regulating means for a predetermined time period when said electrical current applied to said solenoid coil reaches a predetermined value.

* * * * *